US009416922B1

(12) United States Patent
Stagni

(10) Patent No.: US 9,416,922 B1
(45) Date of Patent: Aug. 16, 2016

(54) SWITCHABLE SOLID STATE LIGHTING SYSTEM

(71) Applicant: Inner Lighting, LLC, Plymouth, MN (US)

(72) Inventor: Lee D. Stagni, Plymouth, MN (US)

(73) Assignee: Inner Lighting, LLC, Plymouth, MN (US)

( * ) Notice: Subject to any disclaimer, the term of this patent is extended or adjusted under 35 U.S.C. 154(b) by 32 days.

(21) Appl. No.: 14/321,432

(22) Filed: Jul. 1, 2014

Related U.S. Application Data

(63) Continuation-in-part of application No. 14/210,990, filed on Mar. 14, 2014, now Pat. No. 9,388,946.

(60) Provisional application No. 61/788,321, filed on Mar. 15, 2013.

(51) Int. Cl.

| | |
|---|---|
| ***F21S 8/08*** | (2006.01) |
| ***F21K 99/00*** | (2016.01) |
| ***H05B 33/08*** | (2006.01) |
| ***F21S 6/00*** | (2006.01) |
| *F21V 23/04* | (2006.01) |

(52) U.S. Cl.
CPC ..... *F21K 9/135* (2013.01); *F21S 6/002* (2013.01); *F21S 6/005* (2013.01); *F21S 6/008* (2013.01); *H05B 33/0845* (2013.01); *F21K 9/58* (2013.01); *F21V 23/04* (2013.01)

(58) Field of Classification Search
CPC ..... F21V 23/04; F21S 6/002; F21S 10/023; F21K 9/00; F21K 9/58; F21W 2131/30
See application file for complete search history.

(56) References Cited

U.S. PATENT DOCUMENTS

| | | | | |
|---|---|---|---|---|
| 1,578,127 | A | 3/1926 | Holz | |
| 6,580,228 | B1 * | 6/2003 | Chen | F21K 9/135 257/E25.02 |
| 7,434,964 | B1 | 10/2008 | Zheng et al. | |
| 7,748,877 | B1 | 7/2010 | Colby | |
| 8,198,819 | B2 | 6/2012 | Lenk | |
| 2001/0022723 | A1 * | 9/2001 | Siminovitch | F21S 6/002 362/225 |
| 2011/0075404 | A1 | 3/2011 | Allen et al. | |
| 2011/0131847 | A1 | 6/2011 | Acworth | |
| 2011/0156584 | A1 | 6/2011 | Kim | |
| 2011/0163683 | A1 * | 7/2011 | Steele | F21K 9/135 315/192 |
| 2011/0176316 | A1 * | 7/2011 | Phipps | F21V 29/004 362/373 |
| 2011/0215696 | A1 | 9/2011 | Tong et al. | |
| 2011/0248631 | A1 | 10/2011 | Chuang | |
| 2012/0268936 | A1 | 10/2012 | Pickard et al. | |
| 2013/0063935 | A1 * | 3/2013 | Thrailkill | F21V 29/004 362/231 |
| 2013/0242580 | A1 | 9/2013 | Stephany et al. | |
| 2013/0328493 | A1 | 12/2013 | Munday | |

* cited by examiner

*Primary Examiner* — Peggy Neils
*Assistant Examiner* — Alexander Garlen
(74) *Attorney, Agent, or Firm* — Billion & Armitage; Michael A. Collins

(57) ABSTRACT

Embodiments relate to a lighting device that includes or retains a plurality of solid-state light emitters and is capable of providing one or more of omni-directional lighting and task lighting. Other embodiments relate to modular lighting systems for providing the same.

8 Claims, 21 Drawing Sheets

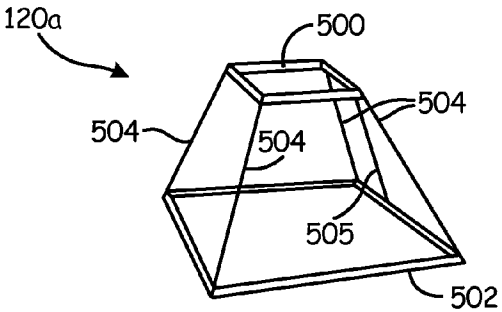
Fig. 5A
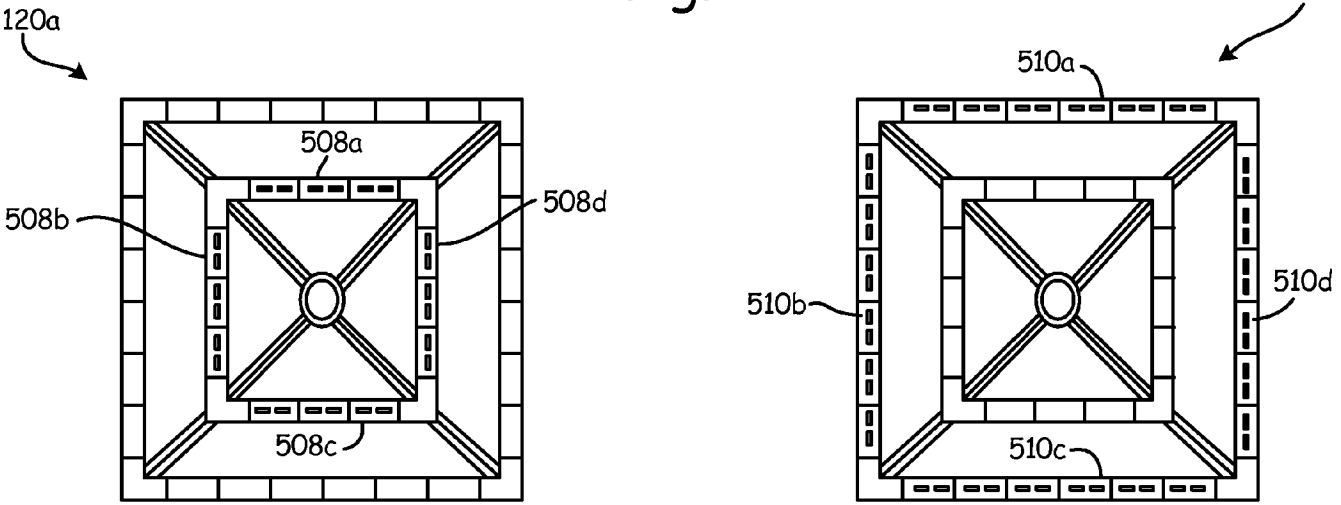
Fig. 5C
Fig. 5B

SWITCHABLE SOLID STATE LIGHTING SYSTEM

CROSS REFERENCE TO RELATED APPLICATIONS

This application is a Continuation-in-Part of U.S. application Ser. No. 14/210,990, filed on 14 Mar. 2014, which claims the benefit of U.S. provisional Application No. 61/788,321, filed on 15 Mar. 2013, the contents of which are incorporated herein by reference. A claim of priority is made.

TECHNICAL FIELD

This disclosure relates to lighting devices, and in particular to lighting devices utilizing solid-state light emitters.

BACKGROUND

Lighting has been typically accomplished by filament light bulbs for about the past 100 years, as originally developed by Thomas Edison (the "Edison Bulb"). Filament light bulbs come in many sizes and use various illuminations based on amounts of energy they consume, e.g., 25 Watts, 40 Watts, 60 Watts, 100 Watts and up. The Edison Bulb uses a threaded base that screws into a standardized base receptacle, which is used to mechanically hold the bulb and provide electrical connectivity to the light bulb (the "Edison Base"). Edison Bulbs are not energy efficient as a significant amount of the energy they consume is converted to heat instead of light. The Edison Bulbs generally emit omni-directional light.

Due to the inefficiency of the Edison Bulb, governments around the world have initiated regulations that will eventually eliminate them from the market. Light emitting diodes (LEDs) are considered an energy efficient successor to filament-based Edison Bulbs. As the world migrates away from the Edison Bulb, a large market opportunity will develop for replacement devices that integrate with the millions of existing lamps with an Edison Bulb receptacle (an "Edison Base").

When lamps are illuminated using Edison Bulbs, the harsh light emitted by the bulb often requires a diffuser. Lampshades serve this purpose. Lampshades have been developed of varying shapes, sizes and materials. Not only do lampshades diffuse bulb light, they are commonly considered an important component in decorating. Today, millions of lamps around the world use lampshades on desks, tables, floors, or wall-mounted lamps.

SUMMARY

Embodiments of the disclosure include lighting devices comprising an illuminated body that includes or retains a first plurality of solid-state light emitters and a second plurality of solid-state light emitters, a first electric circuit connected to provide power to the first plurality of solid-state light emitters, a second electric circuit connected to provide power to the second plurality of solid-state light emitters, and a multi-throw switch coupled to selectively provide power to at least one of the first plurality of solid-state light emitters or second plurality of solid-state light emitters.

Other embodiments relate to modular lighting systems comprising a hub module and at least one illuminating module. A hub module can include a power-receiving port, a power-providing port, and a hub electric circuit. An illuminating module can include a power-receiving port and at least one solid-state light emitter connected to a module electric circuit. At least one illuminating module is capable of electrically connecting to the hub module power-providing port via the power-receiving port.

BRIEF DESCRIPTION OF THE DRAWINGS

FIG. 5A is a perspective view of an illuminated wireframe utilized in a lighting device according to an embodiment of the present invention.

FIGS. 5B-5C are top and bottom views, respectively, of the illuminated wireframe according to an embodiment of the present invention.

DETAILED DESCRIPTION

Figure 1A:
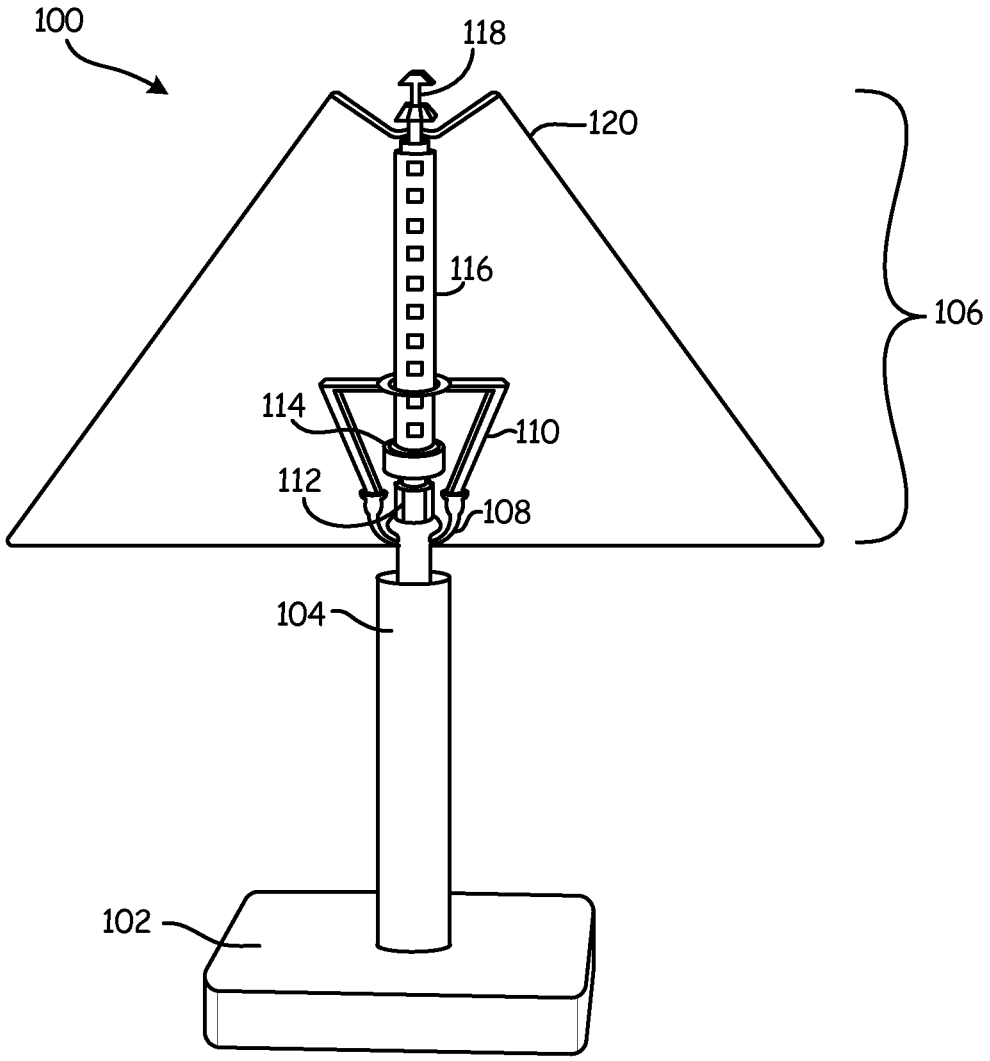
FIGS. 1A and 1B are perspective views of a lighting device according to an exemplary embodiment of the present invention.

Example methods and systems for lighting devices are described. In the following description, for purposes of explanation, numerous specific details are set forth in order to provide a thorough understanding of example embodiments. It will be evident, however, to one of ordinary skill in the art that embodiments of the invention may be practiced without these specific details.

Embodiments of the present invention relate to lamps utilizing a solid-state light emitter such as a light emitting diode (LED). Although LEDs are utilized throughout this description, other solid-state light emitters such as organic light-emitting diodes (OLEDs) may instead be utilized. However, rather than utilize an Edison-style LED light bulb, the present invention arrange LEDs in a way that utilizes the advantages of LED lighting over traditional Edison bulbs. Embodiments of the present invention include an illuminated pole, illuminated shade, and illuminated wireframe, each of which may be used alone or in combination with one another. For example, the illuminated lamp shade can replace existing non-illuminated lampshades and its corresponding light source, such as an Edison Bulb. The lampshade may include a wire frame with a flexible or non-flexible material contacting the wire frame as a covering. The covering may diffuse light from the light source or be used as a decorative element, or both. Embodiments of the present invention also describe a light source module that integrates with an existing lamp stand Edison Base or as a replacement to a lampshade. As an alternative, this invention eliminates the need for a replacement bulb, replacing that bulb with an illumination device that is integrated with or into the lampshade itself, using the Edison Base as its source of electric power.

Solid-state lighting is a newer technology than incandescent lighting and fluorescent lighting that has the potential to far exceed the energy efficiencies of incandescent and fluorescent lighting. Solid-state lighting uses light-emitting diodes or "LEDs" for illumination. Solid-state may refer to the fact that the light in an LED is emitted from a solid object, block of semiconductor, rather than from a vacuum or gas tube, as in the case of incandescent and fluorescent lighting. There are two types of solid-state light emitters: inorganic light-emitting diodes (usually abbreviated LEDs) or organic light-emitting diodes (usually abbreviated OLEDs).

A semiconductor is a substance whose electrical conductivity can be altered through variations in temperature, applied fields (electrical or magnetic), concentration of impurities (e.g., doping), etc. The most common semiconductor material is silicon, which is used predominantly for electronic applications (where electrical currents and voltages are the main inputs and outputs). For optoelectronic applications (where light is one of the inputs or outputs), other semiconductor materials must be used, including indium gallium phosphide (InGaP), which emits amber and red light, and indium gallium nitride (InGaN), which emits near-UV, blue and green light.

A light emitting diode (LED) is a semiconductor diode that emits light of one or more wavelengths. Different wavelengths represent different colors. A diode is a device through which electrical current can pass in only one direction. The electrical current injects positive and negative charge carriers which recombine to create light. The diode is attached to an electrical circuit and encased in a plastic, epoxy, resin or ceramic housing. The housing usually consists of some sort of covering over the device as well as some means of attaching the LED to a source of electrical current. The housing may incorporate one or many LEDs. An LED is typically <1 $mm^2$ in size, or approximately the size of a grain of sand. However, when encased in the housing, the finished product may be several millimeters or more across.

Because the vast majority of LEDs use inorganic semiconductors, the acronym LED normally refers to inorganic-semiconductor-based LEDs. Some LEDs use organic semiconductors (carbon-based small molecules or polymers), and the acronym OLEDs refers to these organic-semiconductor-based LEDs. They are similar to inorganic-semiconductor-based LEDs in that passing an electrical current through an OLED creates an excited state that can then produce light. OLEDs are generally more expensive than LEDs.

Incandescent lamps (conventional Edison Bulbs) create light by heating a thin filament to a very high temperature. Incandescent lamps have low efficiencies because most (over 90%) of the energy is emitted as invisible infrared light (or heat). A fluorescent lamp produces ultraviolet light when electricity is passed through a mercury vapor, causing the phosphor coating inside the fluorescent tube to glow or fluoresce. There are efficiency losses in generating the ultraviolet light, and in converting the ultraviolet light into visible light. Incandescent lamps typically have short lifetimes (around 1,000 hours) due to the high temperatures of the filaments, while fluorescent lamps have moderate lifetimes (around 10,000 hours) that are limited by the electrodes for the discharge. LEDs, on the other hand, use semiconductors that are more efficient, more rugged, more durable, and can be controlled (for example, dimmed) more easily. Small LEDs can have lifetimes up to 100,000 hours.

Light output is commonly measured in lumens, generally, a convolution of the radiated power and the sensitivity of the human eye. A 60-Watt incandescent bulb produces about 850 lumens. The efficiency of lighting (luminous efficacy) is the light output (lumens) produced per unit of input electrical power (Watts)—or lumens/Watt. An incandescent lamp wastes most of its power as heat, with the result that its luminous efficacy is only around 15 lumens/Watt. A fluorescent lamp is much better at roughly up to 85 lumens/Watt. These lighting technologies are very mature and their luminous efficacies have not improved much in many years. Today's white LEDs, at around 100 lumens/Watt, have luminous efficacies that are already better than those of incandescent lamps. Moreover, it is believed possible to increase the luminous efficacies of LEDs to as high as 200-300 lumens/Watt, with further improvements in the underlying materials and device properties and design. In some embodiments, light produced from a combination of red, green, blue, and yellow LED chips can be mixed to generate the desired color of light output (e.g., white light). In other embodiments, blue LED chips with phosphor added are utilized alone to generate the desired white light.

Figure 1B:
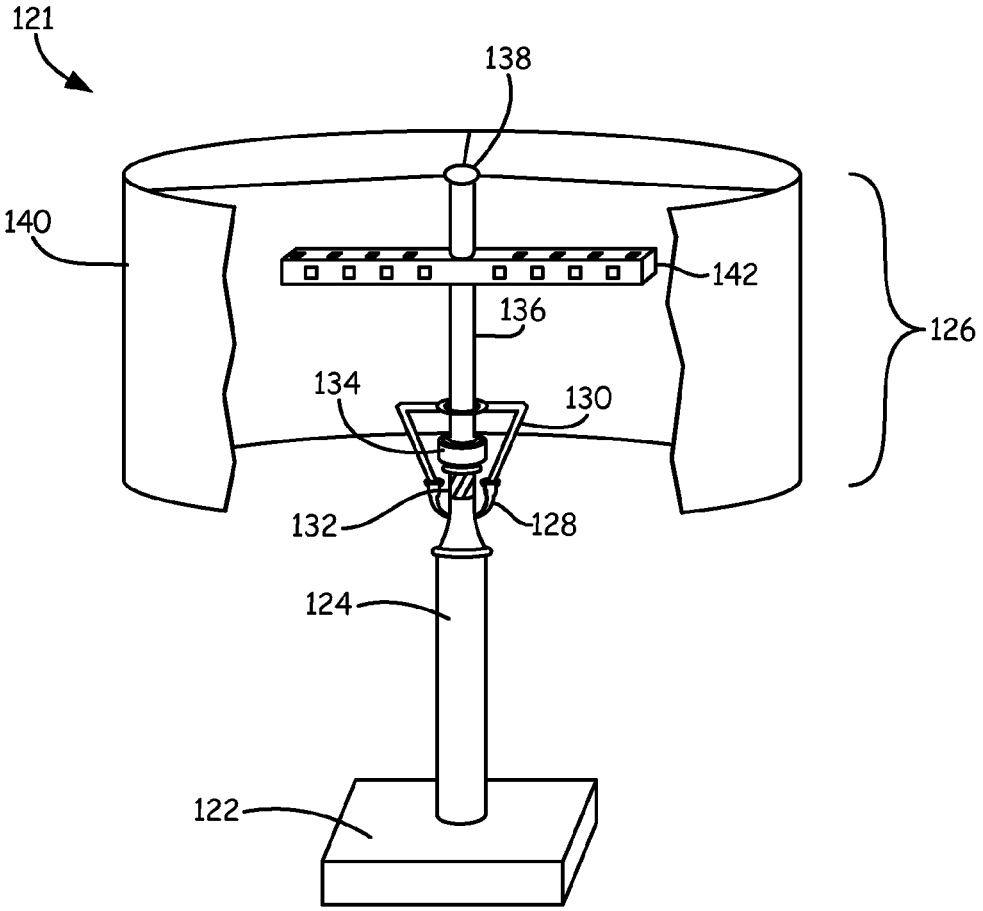

FIGS. 1A and 1B are perspective views of lighting device 100, 121 according to an exemplary embodiment of the present invention. With respect to FIG. 1A, lighting device 100 includes base 102, neck 104, and light fixture portion 106, which includes saddle 108, mini-harp 110, socket 112, power converter base 114, illuminated pole 116, finial 118, and shade 120.

Socket 112 is an electric screw socket configured to receive a light bulb. Converter base 114 includes a screw base (not shown) that mates with socket 112, allowing converter base 114 to be screwed into socket 112. Illuminated pole 116 is affixed to converter base 112. In the embodiment shown in FIG. 1A, illuminated pole 116 includes only a vertical portion, but as described in additional detail with respect to subsequent figures, may utilize a combination of vertical and/or horizontal portions. LED light strips (not shown) are affixed to illuminated pole 116 or formed as part of the light pole. Finial 118 is located at a topmost portion of illuminated pole 116 and is used to secure shade 120 to the illuminated pole.

As discussed in more detail with respect to FIGS. 2A-2D, power converter base 114 is configured to mate with an electric screw socket commonly employed in lighting fixtures that utilize traditional incandescent light bulbs. In this way, light fixture portion 106 may be retrofitted for use in a traditional lighting device or fixture. In one embodiment, power converter base 114 includes passive and/or active power devices used to convert alternating current (AC) power (e.g., wall outlet power) to a direct current (DC) power provided to LEDs utilized by light fixture portion 106. In other embodiments, LEDs utilized by light fixture portion 106 may be AC devices, in which case power converter base 114 would not provide any power conversion function.

As described in more detail below, light fixture portion 106 does not rely on traditional light bulbs. Rather, light fixture portion 106 utilizes LEDs located and affixed at one or more locations, including illuminated pole 116 and/or shade 120.

Illuminated pole 116 utilizes a plurality of LEDs positioned around an exterior surface. The spacing and orientation of the LEDs determines the intensity (i.e., amplitude) of the light as well as the direction. In one embodiment, illuminated pole 116 may include a plurality of flat vertical surfaces, facing different directions, for affixing or adhering LEDs to provide omni-directional light. In other embodiments, illuminated pole 116 further includes a horizontal component for affixing or adhering LEDs to provide additional light in a downward direction. Various configurations and geometries of vertical and horizontal portions of illuminated pole 116 may be utilized, as discussed in more detail below, to provide desired lighting effects.

In the embodiment shown in FIG. 1A, saddle 108 is generally U-shaped and is affixed between socket 110 and neck 104. Saddle 108 is positioned and configured to retain mini-harp 110. In traditional lighting devices, a harp device is retained by the saddle, and is shaped to extend around the light bulb installed in socket 110. The harp would provide support for a lampshade, and would also ensure proper spacing between the lampshade and the incandescent bulb to prevent burning of the lampshade. However, in the embodiment shown in FIG. 1A, illuminated pole 116 provides support for a lampshade affixed at the top of the light pole. The mini-harp 110 is secured to saddle 108 to provide lateral stability to illuminated pole 116. Mini-harp 110 may be formed integrally with illuminated pole 116 or separately. For example, if separate, illuminated pole 116 would be installed or affixed to converter base 112, and then mini-harp 110 would be placed over illuminated pole 116 and connected to saddle 108.

Lampshade 120 is affixed at the top of illuminated pole 116. In one embodiment, lampshade 120 also utilizes LED lights, either alone or in combination with illuminated pole 116. As discussed in more detail below, illuminated pole 116 may be utilized as the sole source of light, lampshade 122 may be utilized as the sole source of light, or a combination thereof.

With respect to FIG. 1B, lighting device 121 includes base 122, neck 124, and light fixture portion 126, which includes saddle 128, mini-harp 130, socket 132, power converter base 134, hollow pole 136, finial 138, shade 140, and illuminated horizontal pole 142. Lighting device 121 is essentially the same as lighting device 100 described with respect to FIG. 1A. That is, power converter base 134—similar to power converter base 114—is configured to mate with an electric screw socket (i.e., an Edison socket) commonly employed in lighting fixtures that utilize traditional incandescent light bulbs. As a result, light fixture portion 126 may be retrofitted for use in a traditional lighting device or fixture. In contrast with the embodiment shown in FIG. 1A, however, lighting device 121 does not include any LEDs affixed to vertical portion 136. Rather, illuminated horizontal pole 142 is affixed to hollow pole 136. A plurality of LEDs are positioned around an exterior surface of illuminated horizontal pole 142 to provide the desired illumination for lighting device 121. In the embodiment shown in FIG. 1B, illuminated horizontal pole 142 includes four flat surfaces to which LEDs may be affixed, however, any number of flat and/or curved surfaces may be utilized for affixing LEDs. In addition, it should be noted that illuminated horizontal pole 142 may be used in conjunction with illuminated vertical pole 116 described with respect to FIG. 1A.

A benefit of utilizing illuminated horizontal pole 142 is that it allows for aesthetically different shaped lampshades. In particular, lamp shades 140 may be long in a horizontal direction as shown in FIG. 1B.

Figure 2A:
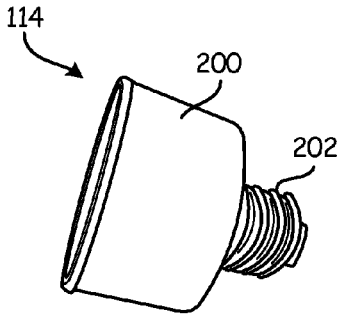
FIGS. 2A-2D are perspective views of a power connector/converter base utilized in a lighting device according to an embodiment of the present invention.
Figure 2B:
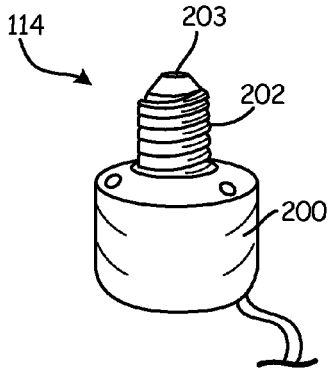
Figure 2C:
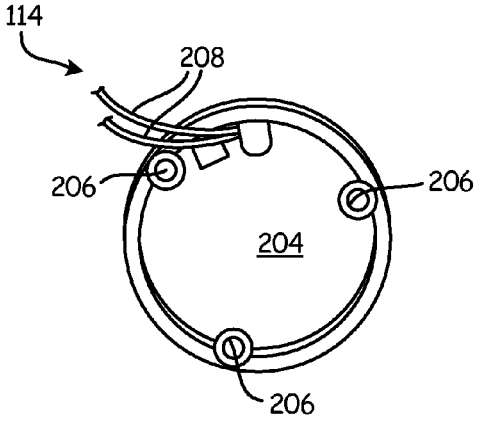
Figure 2D:
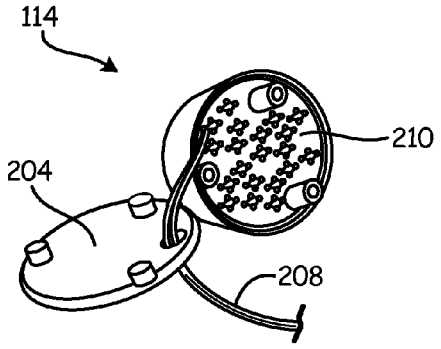

FIGS. 2A-2D are perspective views of power connector/converter base 114 (shown in FIG. 1) utilized in a lighting device according to an embodiment of the present invention. In particular, FIGS. 2A-2B are side views of power connector/converter base 114. FIG. 2C is a top view of power connector/converter base 114, and FIG. 2D is a perspective view of power connector/converter base 114 with a cover removed to illustrate the housed power connector/converter electronics. In some embodiments, the LEDs utilized by the lighting device require direct current (DC) power as opposed to the alternating current (AC) power provided by a wall outlet. In this embodiment, power connector/converter base 114 includes power conversion electronics for converting the AC wall power to DC power for consumption by the LEDs. In other embodiments, LEDs are capable of utilizing AC power, and no power conversion is required. In this embodiment, power connector/converter base 114 provides an electrical connection to Edison style electric screw socket, but does not provide any power conversion.

As shown in FIGS. 2A-2B, power converter base 114 includes power conversion unit 200 and screw thread contact 202. Power conversion unit 200 houses electrical components utilized to convert AC power to DC power. Screw thread contact 202 and electrical foot contact 203 (shown in FIG. 2B only) provide the electrical connection between socket 112 (shown in FIG. 1) and power converter base 114. In particular, AC power delivered by socket 112 is provided via screw thread contact 202 (and returned via electrical foot contact 203) to power conversion unit 200 for conversion to DC power. As noted above, in embodiments utilizing AC LEDs, no power conversion would be required and power conversion unit 200 would simply provide the housing necessary to support illuminated pole 116 (also shown in FIG. 1).

FIG. 2C is a top view of power converter base 114 that illustrates cover portion 204 associated with power conversion unit 200, which includes a plurality of apertures 206 positioned to receive fasteners for attaching illuminated pole 116 to power converter base 114. Although the embodiments shown in FIGS. 2A-2D utilize screws to engage and attach illuminated pole 116 to power converter base 114, in other embodiments other well-known means of fastening may be utilized. A pair of wires 208 extend through cover portion 204, providing DC power provided by power conversion unit 200 to an interior portion of Illuminated pole 116 for distribution to the LEDs.

FIG. 2D illustrates electronic components 210 housed within power conversion unit 200 for converting AC power to DC power. In one embodiment, power conversion is provided by passive power components (e.g., diodes). In another embodiment, power conversion is provided by active power components (e.g., power transistors) turned On and Off to convert AC power to DC power.

Figure 3B:
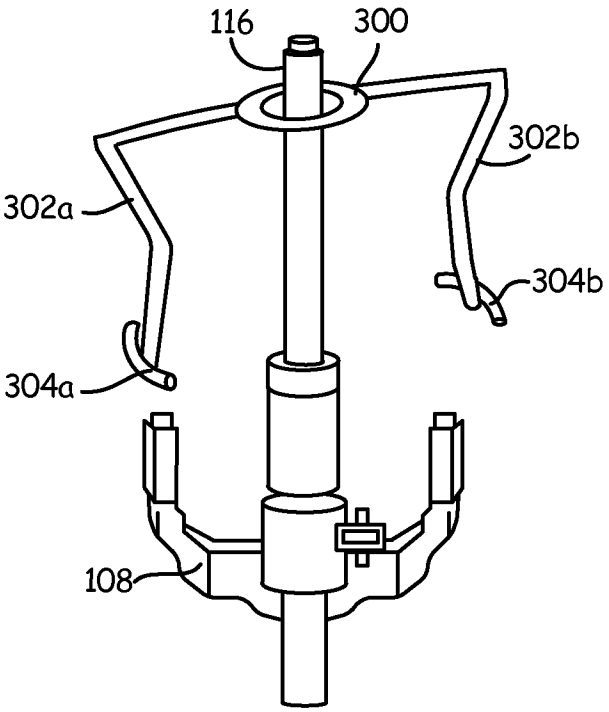
FIGS. 3A-3B are perspective views of a mini-harp/stability device utilized in a lighting device according to an embodiment of the present invention.
Figure 3A:
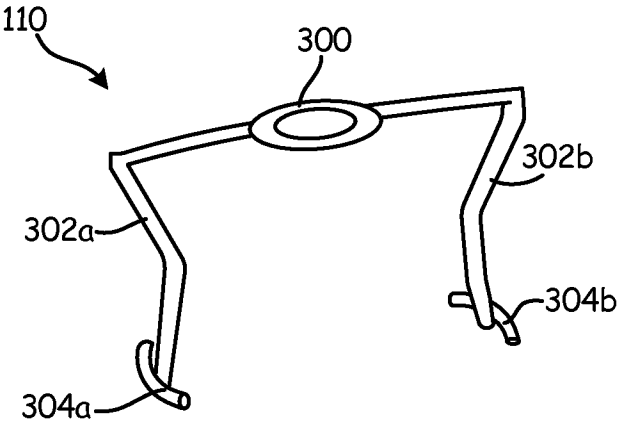

FIGS. 3A-3B are perspective views of mini-harp 110 utilized in a lighting device according to an embodiment of the present invention. In the embodiment shown in FIG. 3A, mini-harp 110 includes ring portion 300, leg portions 302*a* and 302*b*, and connection portions 304*a* and 304*b*. As illustrated in the embodiment shown in FIG. 3B, ring portion 300 is configured to fit over illuminated pole 116. To this end, the geometry of ring portion 300 is configured to match the geometry of illuminated pole 116. For example, in the embodiment shown in FIG. 3B, the light pole is circular, and therefore ring portion 300 is also circular. In embodiments in which illuminated pole 116 is triangular, then ring portion 300 would similarly by triangular in order to match the geometry and provide better support for the light pole. Legs 302*a* and 302*b* extend away from ring portion 300 and then downward to connection portions 304*a* and 304*b*. In particular, when connection portions 304*a* and 304*b* are affixed to saddle 108, then mini-harp 110 provides lateral support that maintains illuminated pole 116 in a vertical position and prevents the light pole from wobbling within socket 112 (shown in FIG. 1).

As compared with harps utilized in "traditional" incandescent lighting fixtures, mini-harp 110 is not required to provide support for the lampshade and is not required to maintain a minimum safe distance between the lampshade and the hot light bulb. Therefore, mini-harp 110 does not extend to the top of illuminated pole 116, but rather provides lateral support (via ring portion 300) near the lower portion of illuminated pole 16.

Figure 4B:
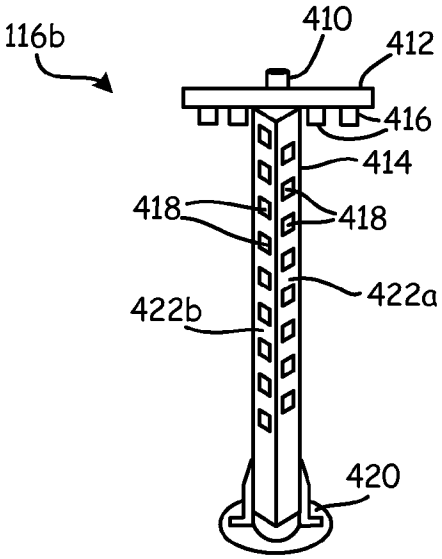
FIGS. 4A-4C are perspective views of an illuminated pole utilized in a lighting device according to an embodiment of the present invention.
Figure 4A:
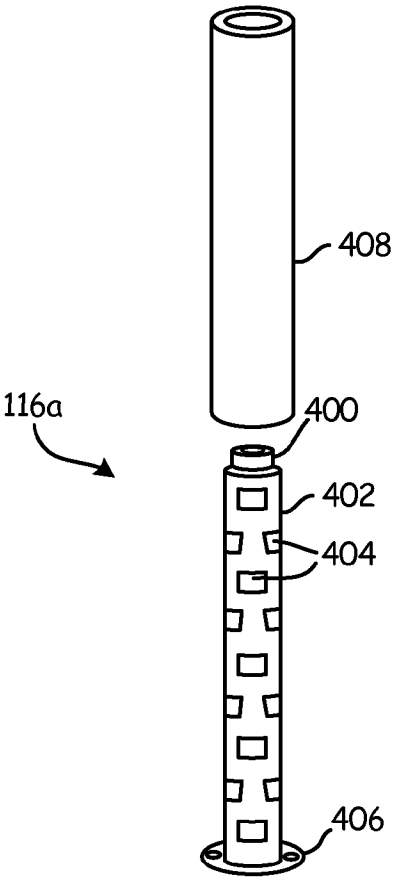
Figure 4C:
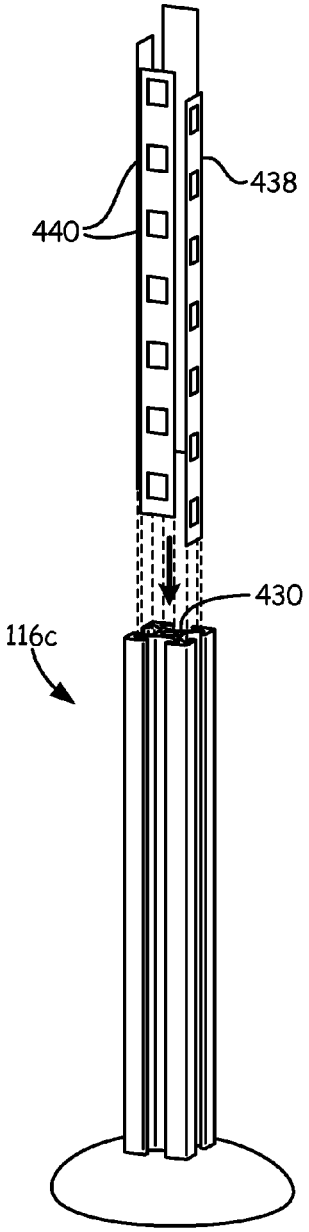
Figure 4D:
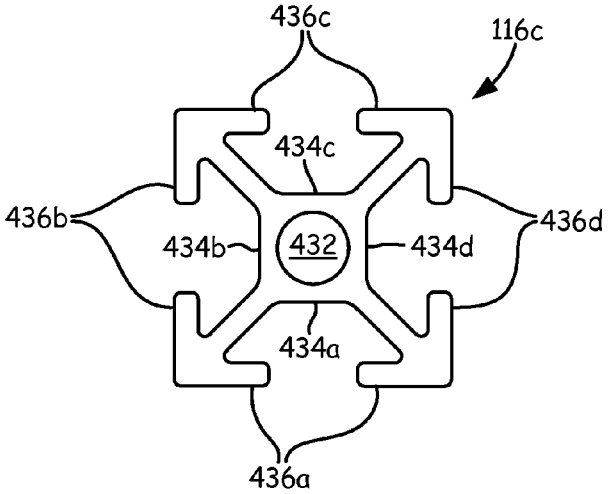
FIG. 4D is a top view of an illuminated pole utilized in a lighting device according to an embodiment of the present invention.

FIGS. 4A-4C are perspective views of illuminated pole 116*a*, 116*b*, and 116*c*, respectively, utilized in a lighting device according to embodiments of the present invention, and FIG. 4D is a top view of illuminated pole 116*c* according to embodiment of the present invention.

In the embodiment shown in FIG. 4A, illuminated pole 116*a* includes hollow interior portion 400, vertical pole 402, a plurality of light-emitting diodes (LEDs) 404, base portion 406, and hollow, light-diffusing sleeve 408. Base portion 406 is used to secure illuminated pole 116*a* to power converter base 114. In the embodiment shown in FIG. 4A, base portion 406 is wider that vertical pole 402 and includes a plurality of screws or posts 408 for affixing illuminated pole 116 to power converter base 114.

Hollow interior portion 400 extends from base portion 406 along the vertical length of illuminated pole 116*a*. In the embodiment shown in FIG. 4A, hollow interior portion 400 is used to house power carrying wires 208 (shown in FIG. 2D) provided by power converter base 114. In other embodiments, power supplied by wires 208 may be connected near the base (i.e., bottom) of illuminated light pole 116*a*. However, in embodiments in which a horizontal portion (as shown in FIG. 4B) is also utilized, it is beneficial to make all connections in one location (i.e., near the top of illuminated light pole 116*a*). For these embodiments, it is beneficial to locate wires (208) through the interior of hollow interior portion 400 from power converter base 114 to the top of illuminated light pole 116*a*.

In the embodiment shown in FIG. 4A, vertical pole 402 is rounded or circular. The plurality of LEDs 404 are spaced around the outer circumference of vertical pole 402. The number of LEDs 404 and spacing of LEDs 404 determines the magnitude or amplitude of light provided by illuminated light pole 116*a*. To prevent the plurality of individual LEDs appearing as dots of lights to an observer (if this is an undesired design), the plurality of LEDs 404 are spaced closely enough together, and far enough from lampshade 120 to allow mixing of the light emitted from adjacent LEDs 404. For example, in the embodiment shown in FIG. 4A, each row of LEDs extending around the circumference of vertical pole 402 is staggered from adjacent rows. In other embodiments, other arrangements of LEDs may be utilized to provide the desired intensity and mixing of light.

In the embodiment shown in FIG. 4A, hollow, light-diffusing sleeve 408 is fit over vertical pole 400 and light emitting diodes 404. The purpose of light-diffusing sleeve 408 is to diffuse the light emitted by individual LEDs such that a user cannot distinguish one LED from another along vertical pole 400. In addition, because LEDs emit a low amount of heat, sleeve 408 may be located adjacent to or very close to the plurality of LEDs 404. In one embodiment, light-diffusing sleeve 408 is constructed of a semi- to mostly-translucent cast acrylic or extruded acrylic with light transmission characteristics that provides the desired re-direction and/or diffusion of light. Although other materials may be utilized, a benefit of acrylics is they provide outstanding resistance to long-term exposure to sunlight and weathering, have excellent optical properties, and are more resistant to impact than glass. In addition, acrylics are easier to machine and manufacture, and is resistant to water (i.e., low-water absorption).

The embodiment shown in FIG. 4B, illuminated light pole 116*b* includes hollow interior portion 410, horizontal top portion 412, vertical pole 414, a first plurality of light-emitting diodes (LEDs) 416, a second plurality of LEDs 418, and base portion 420.

Base portion 420 is once again used to secure illuminated light pole 116*b* to power converter base 114. Hollow interior portion 410 is utilized to allow wires 208 (shown in FIG. 2D) carrying power from power converter base 114 to supply power near the top of illuminated light pole 116*b*.

Horizontal top portion 412 is located around hollow interior portion 410 and includes a first plurality of LEDs 416 located on a downward facing portion of horizontal top portion 412. The first plurality of LEDs 416 are affixed or otherwise adhered to horizontal top portion 412. In one embodiment, the first plurality of LEDs 416 are formed on a strip that can then be adhered directly to the bottom surface of horizontal top portion 412. A benefit of including horizontal top portion 412 in addition to vertical pole 414 is that LEDs 416 provide light in a downward direction that is particularly desirable in some applications.

In the embodiment shown in FIG. 4B, vertical pole 414 includes a plurality of flat faces, rather than a circular geometry. For example, in the embodiment shown in FIG. 4B, vertical pole 414 includes three flat faces (only faces 422*a* and 422*b* are visible). By utilizing flat faces, rather than a curved surface, vertical pole 414 may utilize LED strips adhered to each of the flat surfaces. The second plurality of LEDs 418 are then affixed to each of the flat surfaces 422*a*-422*c*. In particular, the second plurality of LEDs 418 may be manufactured on a strip that is then adhered to each of the plurality of flat surfaces. The flat surface is particularly beneficial when utilizing LED strips because of the ease of adhering the LED strips to a flat surface. In addition, placing LEDs on each of the plurality of flat surfaces 422*a*-422*c* provides omni-directional light desired in most lighting applications. Although the embodiment shown in FIG. 4B utilizes three flat surfaces, other embodiments may make use of three or more flat surfaces (e.g., four, five, six, etc.). In the embodiment shown in FIG. 4B, the plurality of LEDs 418 associated with flat surface 422*a* are offset vertically from the plurality of LEDs 418 associated with flat surface 422*b*. Similarly, the LEDS (not shown) associated with other flat surfaces may similarly be offset relative to each of the other flat surfaces, or offset only relative to adjacent flat surfaces. The degree or amount of offset may, in one embodiment, be selected to ensure overlap of viewing angles between LEDs on adjacent flat surfaces, such that light emitted by LEDs on different flat surfaces overlap with one another to improve the consistency of light provided to a user.

Power for the first plurality of LEDs 416 and second plurality of LEDs 418 is provided by wires 208 provided by power converter base 114 via hollow interior portion 410. A benefit of providing power through hollow interior portion 410 to the top of illuminated pole 116*b* is that all LEDs, whether positioned on the horizontal surface or one of the vertical surfaces, can be connected at one location.

In the embodiment shown in FIG. 4C, illuminated pole 116*c* includes hollow square pole 430 having hollow portion 432, four flat surfaces 434*a*-434*d*, retainer tabs 436 extending vertically along edges of each flat surface 434*a*-434*d*, and LED module 438 designed to be slid into and retained by tabs 436.

In the embodiment shown in FIG. 4C, rather than adhere LEDs or LED strips directly to flat surface of vertical pole 430, the pole includes with respect to each flat surface retainer tabs 436. In the embodiment shown in FIG. 4C, retainer tabs (e.g., 436*a*) are positioned at opposite sides of each flat surface (e.g., 434*a*). A flat LED strip or module 438—carrying a plurality of LEDs 440—is slidingly engaged with retainer tabs to affix LED module 438 to a flat surface of square pole 430 without requiring use of an adhesive or other types of mechanical connection (e.g., screw). The depth of retainer tabs 436*a*-436*d* is designed to accommodate the width of LED strips 438, such that retainers tabs 436*a*-436*d* snugly retain LED strips 438 without obscuring light generated by the plurality of LEDs 440. In some embodiments, the plurality of LEDs 440 may protrude beyond the surface of LED module 438 such that the actual LED would extend through the gap provided between opposing retainer tabs 436.

Once again, power for the plurality of LEDs 440 is provided via hollow interior portion 430. A benefit of providing power through hollow interior portion 430 to the top of illuminated pole 116*c* is that all LEDs, whether included as part of LED modules 438 or positioned on a horizontal surface (such as that shown in FIG. 4B) can be connected at a single location.

The embodiments described with respect to FIGS. 4B and 4C may similarly make use of a light-diffusing sleeve fitted around the exterior of each vertical and/or horizontal pole. In each embodiment, the geometry of the light-diffusing sleeve would be selected to match the geometry of the horizontal and/or vertical pole.

FIG. 4D is a top view of hollow, square pole 430 that illustrates the location and geometry of retainer tabs 436*a*-436*d* according to an embodiment of the present invention. As described above, a pair of retainer tabs 436 is associated with each flat surface of hollow, square pole 430. In the embodiment shown in FIG. 4D, retainer tabs 436*a*-436*d* have a curved geometry, but in other embodiments may utilize whatever geometry is best suited to mate with and retain LED modules 438. FIG. 5A is a perspective view of illuminated shade 120*a* according to an embodiment of the present invention. FIG. 5B-5C are top and bottom views, respectively, of illuminated shade 120*a* according to an embodiment of the present invention. Illuminated shade 120*a* may be used in conjunction with or in place of illuminated pole 116 described with respect to FIGS. 4A and 4B.

Illuminated shade 120*a* includes top portion 500 and bottom portion 502, connected by structural wires 504 (or other suitable material) for providing structural support between top portion 500 and bottom portion 502. A traditional square design is illustrated in FIGS. 5A-5C, although in other embodiments (such as that shown in FIG. 6), other designs may be readily adapted for use as an illuminated shade. Although not shown in FIG. 5A, downward facing LEDs are adhered to the bottom surface of top portion 500, while upward facing LEDs are adhered to the top surface of bottom portion 502. As a result, light is directed both upward and downward through illuminated shade 120*a*. Power is once again provided to the LEDs via hollow interior portion of illuminated pole 116 (even if no LEDs are affixed to the illuminated pole). In the embodiment shown in FIG. 5A, power is distributed from top portion 500 to bottom portion 502 via wire 505. Although not shown in this view, fabric or other lampshade material is wound or affixed around structural wires 504. Power wire 505 may be adhered to an interior portion of this fabric (as shown in FIG. 5A) or along one of the structural wires 504.

FIG. 5B is bottom view of illuminated shade 120*a* that illustrates the location of LED modules 508*a*-508*d* along the bottom surface of top portion 500. Similarly, FIG. 5C is top view of illuminated shade 120*a* that illustrates the location of LED modules 510*a*-510*d* along the top surface of bottom portion 502. A benefit of utilizing an illuminated shade design with straight surfaces is that, once again, LED strips may be easily adhered or otherwise affixed to the straight surfaces. In the embodiment shown in FIGS. 5A-5C, a traditional square design is utilized, although various other shapes or geometries may be utilized.

Figure 6:
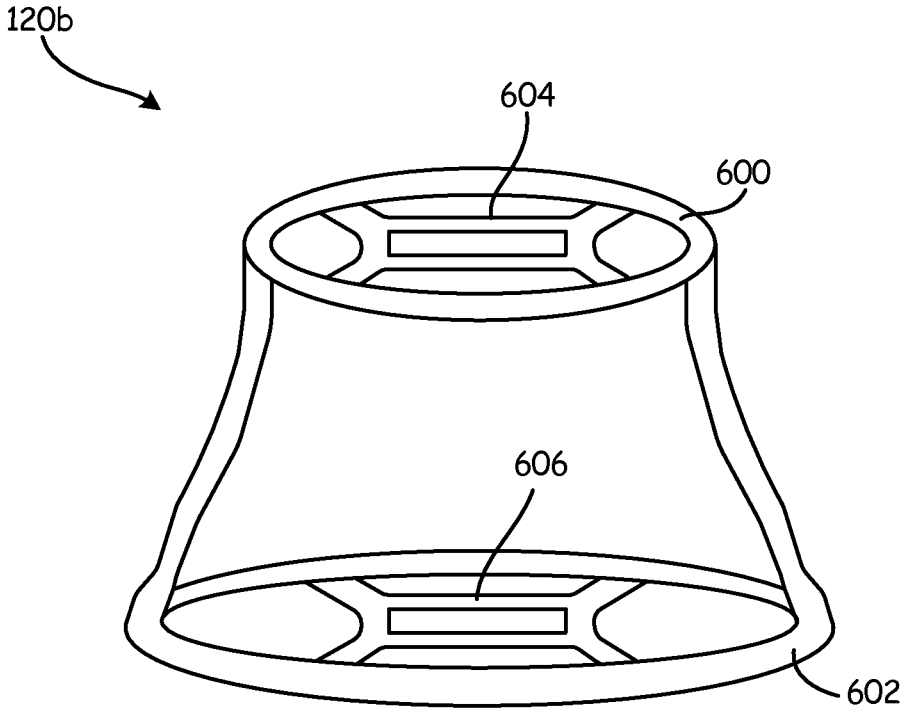
FIG. 6 is a perspective view of an illuminated wireframe utilizing in a lighting device according to another embodiment of the present invention.

For example, FIG. 6 is a perspective view of illuminated shade 122*b* that utilizes a circular geometry. In particular, illuminated shade 122*b* includes top portion 600 and bottom portion 602. Although LEDs may be adhered to the bottom surface of top portion 600 and the top surface of bottom portion 602 (as described with respect to FIGS. 5A-5C), in the embodiment shown in FIG. 6, a square top portion 604 and square bottom portion 606 are utilized to provide flat, straight surfaces for which to adhere LEDs. In particular, square top portion 604 is structurally supported by top portion 600, but provides flat, straight surfaces for which to adhere LEDs or LED strips. Likewise, square bottom portion 606 is structurally supported by bottom portion 602, but provides flat, straight surfaces for which to adhere LEDs or LED strips.

In the embodiment shown in FIGS. 5A-6, top portions (500, 600) and bottom portions (502, 602) are constructed as part of illuminated shade 122*a*, 122*b*, respectively. That is, top portion 500, 600 and bottom portion 502, 602 are not retrofitted onto an existing shade. However, in the embodiment shown in FIGS. 7A-7B, a bracket assembly is utilized that allows any lampshade to be retrofitted as an illuminated lampshade. In addition, the embodiment shown in FIGS. 7A-7B may be utilized in the manufacturing process of a new lampshade, taking advantage of the modular aspects of the brackets to simplify construction.

Figure 7A:
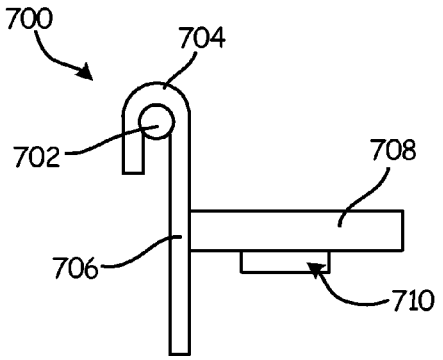
FIG. 7A-7B are cross-sectional views illustrating brackets used to affix light-emitting diode (LED) strips to the wireframe according to an embodiment of the present invention.
Figure 7B:
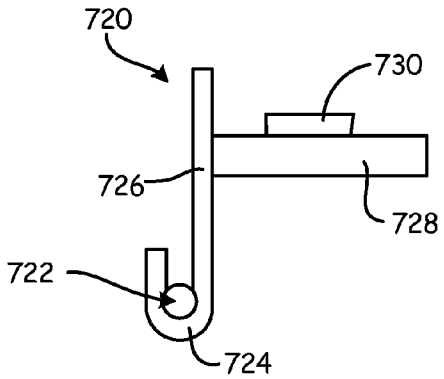

FIGS. 7A-7B are cross-sectional views illustrating brackets 700 and 720, respectively, used to affix light-emitting diode (LED) strips to a wireframe shade according to an embodiment of the present invention. In the embodiment shown in FIGS. 7A-7B, the shade utilizes a wireframe that is utilized to attach brackets 700 and 726. For example, the top of the shade includes wire 702, which may either curved or straight. Bracket 700 includes a "U-shaped" portion or hook 704 that is configured to fit over wire 702 and retain bracket 700. A vertical portion 706 extends from U-shaped portion 704. In the embodiment shown in FIG. 7A, U-shaped portion 704 and vertical portion 706 are integrally formed. Shelf 708 extends from vertical portion 706 and provides the surface for adhering LEDs 710. The location of shelf 708 relative to wireframe 702 ensures that shelf 708 and LEDs 710 are not visible.

Likewise, as shown in FIG. 7B, bracket 720 is attached to wire 722 located on the bottom portion of the shade. In one embodiment, bracket 720 is identical to bracket 700 discussed with respect to FIG. 7A, just oriented in the opposite direction in order to direct light in an upward direction. Bracket 720 includes "U-shaped" portion or hook 724, vertical portion 726, and shelf 728. Because of the change in orientation of bracket 720, LEDs 730 are affixed to a top facing surface of shelf 728.

Figure 7C:
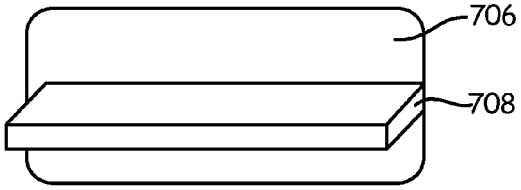
FIG. 7C is a perspective view that illustrates a mounting shelf portion of a bracket used to affix LED strips to the wireframe according to an embodiment of the present invention.

FIG. 7C is a perspective view that illustrates the location of shelf 708 (or 728) relative to vertical portion 706 (or 726). The width of shelf 728 is selected based on the number and type of LEDs to be affixed to the shelf. For example, in embodiments in which the plurality of LEDs are formed on a strip, the width of shelf 728 is at least as wide as the strip. In this way, bracket 700 (and 720) provides a way for attaching LEDs to a wireframe lampshade.

Figure 7D:
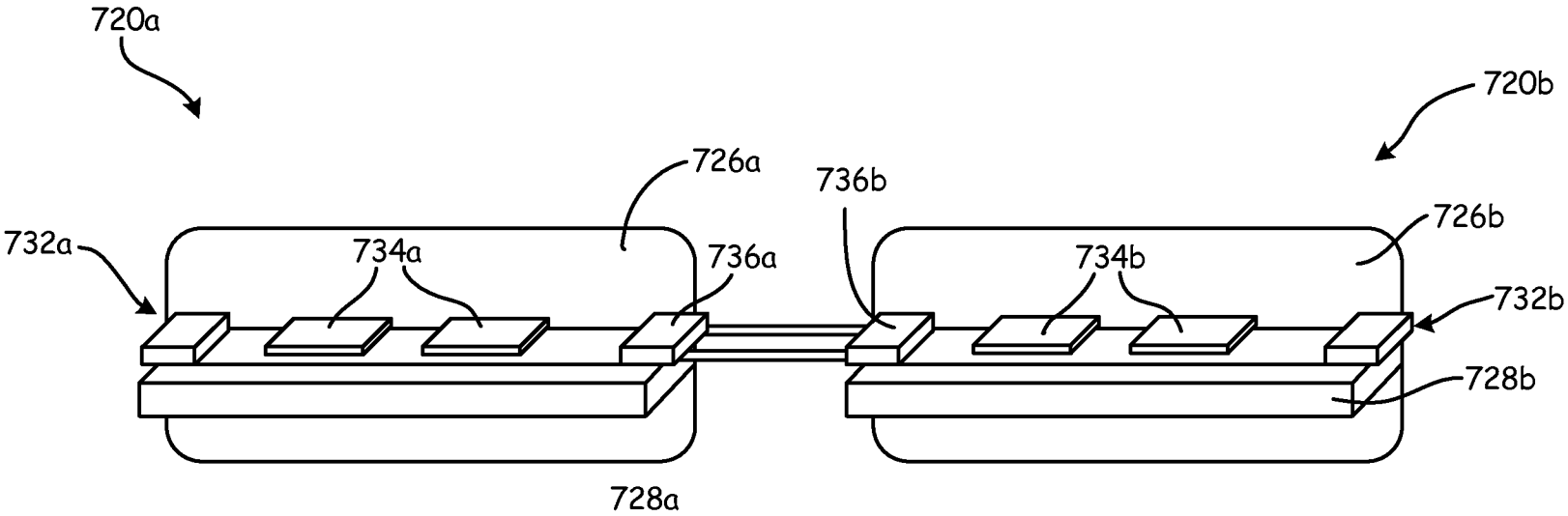
FIG. 7D is a perspective view that illustrates the connection of adjacent, modular brackets according to an embodiment of the present invention.

FIG. 7D is a perspective view that illustrates the connection of adjacent, modular brackets 720*a* and 720*b*. With respect to bracket 720*a*, vertical portion 726*a* and shelf 728*a* are visible. LED strip 732*a* is affixed to the surface of shelf 728*a* and includes a plurality of LEDs 734*a* and connection terminal 736*a*. Similarly, with respect to bracket 720*a*, vertical portion 726*b* and shelf 728*b* are visible. LED strip 732*b* is affixed to the surface of shelf 728*b* and includes a plurality of LEDs 734*b* and connection terminal 736*b*. As illustrated in FIG. 7D, connection terminal 736*a* mates with connection terminal 736*b* to connect LED strip 734*a* to LED strip 734*b*. A benefit of this modular design is LED strips do not need to be cut to a specific length to match the length of the lampshade. Rather, a plurality of modular brackets 720*a* can be utilized to create a desired length of LED lighting panel.

In the embodiment shown in FIG. 7D, connection terminal 736*a* is a "locking" wire connector, which accepts the unshielded end of a shielded electric wire, but once installed prevents the wire from being released until a release clip is engaged. In another embodiment, connection terminal 736*a* is a solder-less wire connector. In yet another embodiment, modules are connected to one another by male-female electrical connectors, such as universal serial bus (USB) type connectors.

Figure 8:
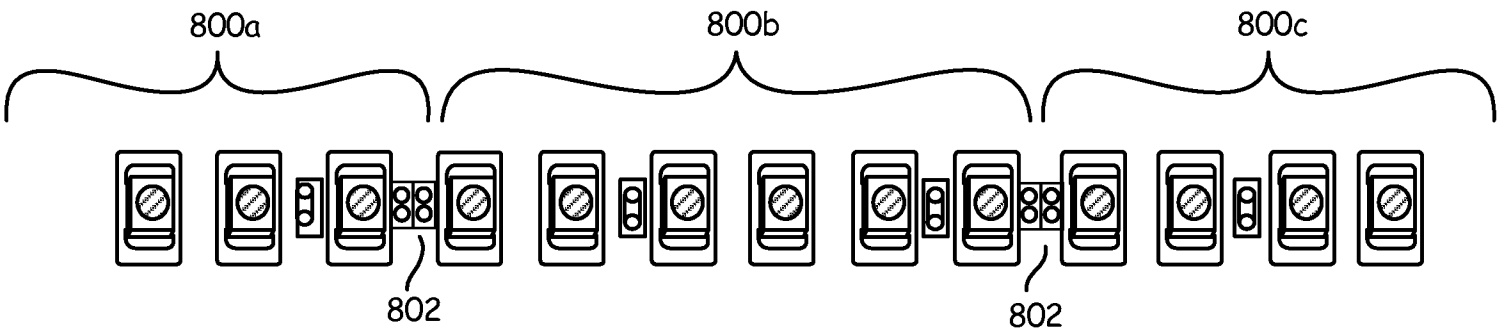
FIG. 8 is a perspective view illustrating LED strip modules connected to one another according to exemplary embodiments of the present invention.
Figure 9A:
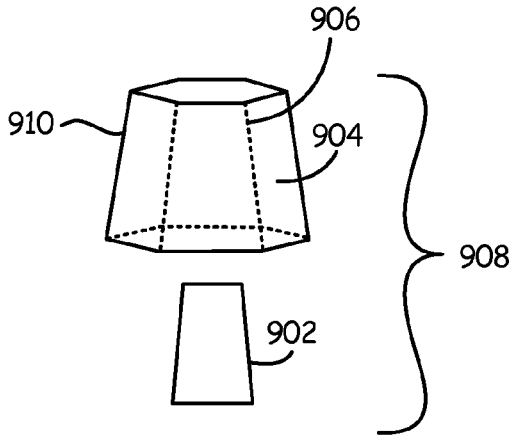
FIGS. 9A-9D are perspective views of an illuminated lampshade according to an embodiment of the present invention.
Figure 9B:
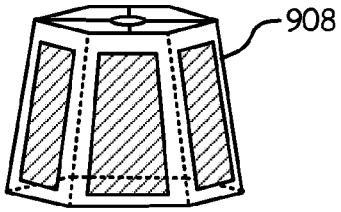
Figure 9C:
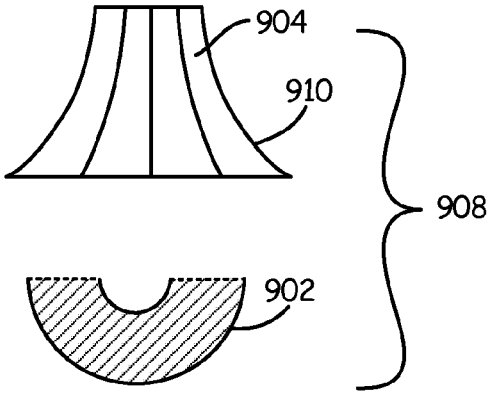
Figure 9D:
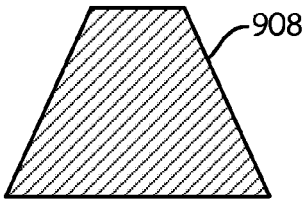

FIG. 8 is a top view of a plurality of LED strip modules 800*a*-800*c* connected to one another according to an embodiment of the present invention. LED strip modules, such as those shown in FIG. 8, may be utilized in any of the previous embodiments described with respect to FIGS. 1-7D. A benefit of utilizing LED strip modules is that LED strips are manufactured in large rolls, can be cut to whatever length is necessary. For example, in the embodiment shown in FIG. 8, the LED strip has been cut and connected to another strip at locations 802 and 804.

Referring to FIGS. 9A-D, perspective views 900 of an illuminated lampshade is shown, according to an embodiment. A lampshade 910 includes a wire frame 906 with covering material 904 in contact with the wire frame 906. One or more illumination panels 902, such as LED panels, integrate with one or more of the wire frame 906 and covering material 904 to form an illumination lampshade 908.

The one or more illumination panels 902 can include a plurality of light emitters. The light emitters are solid state light emitters, e.g., light emitting diodes, or organic light emitting diodes, are set in or on a panel to mechanically support the light emitters. Alternately, the LED semiconductor device may be installed directly onto the lampshade material. The panel 902 may be rigid, flexible or semi-flexible. The panels 902 can include numerous panels in electrical connection or a single panel configured to conform with one or more of the wire frame 906 or covering material 904. The panels 902 may be a two piece panel, for example. The illumination or light source emitters integrated with the panel includes one or more of LED, Organic LED, plasma light source and electroluminescent light source. The light emitters may face inwardly, outwardly or a combination thereof. The panels 902 may be supported by the wire frame 906, for example. The panels 902 may contact one or more surfaces with one or more portions of the wire frame 906 for mechanical support, electrical connectivity or both. The panels 902 may be positioned in the same plane as the wire frame 906 or covering 904 or may be offset from one or both.

Figure 12A:
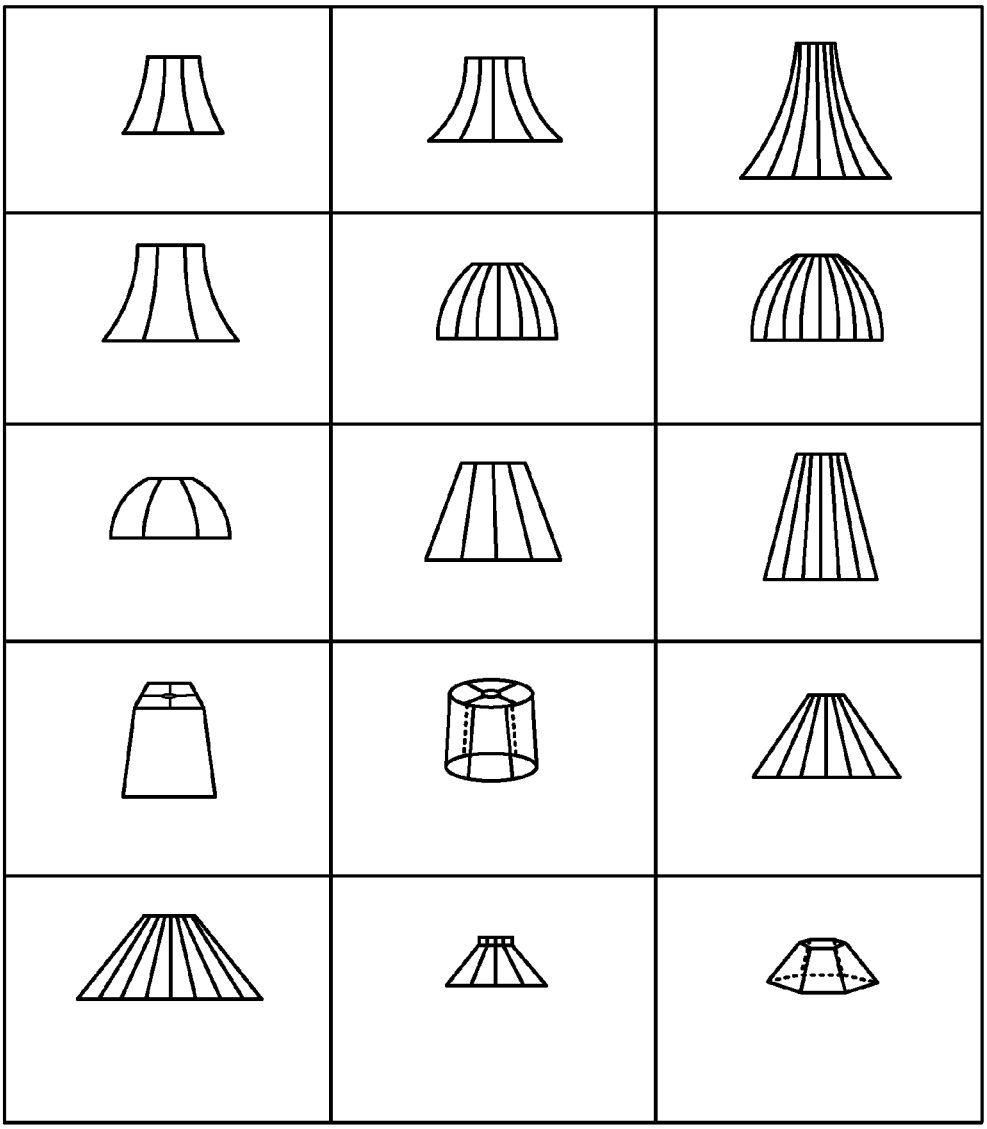
FIGS. 12A-12C are schematic views of lampshade shapes according to an embodiment of the present invention.
Figure 12B:
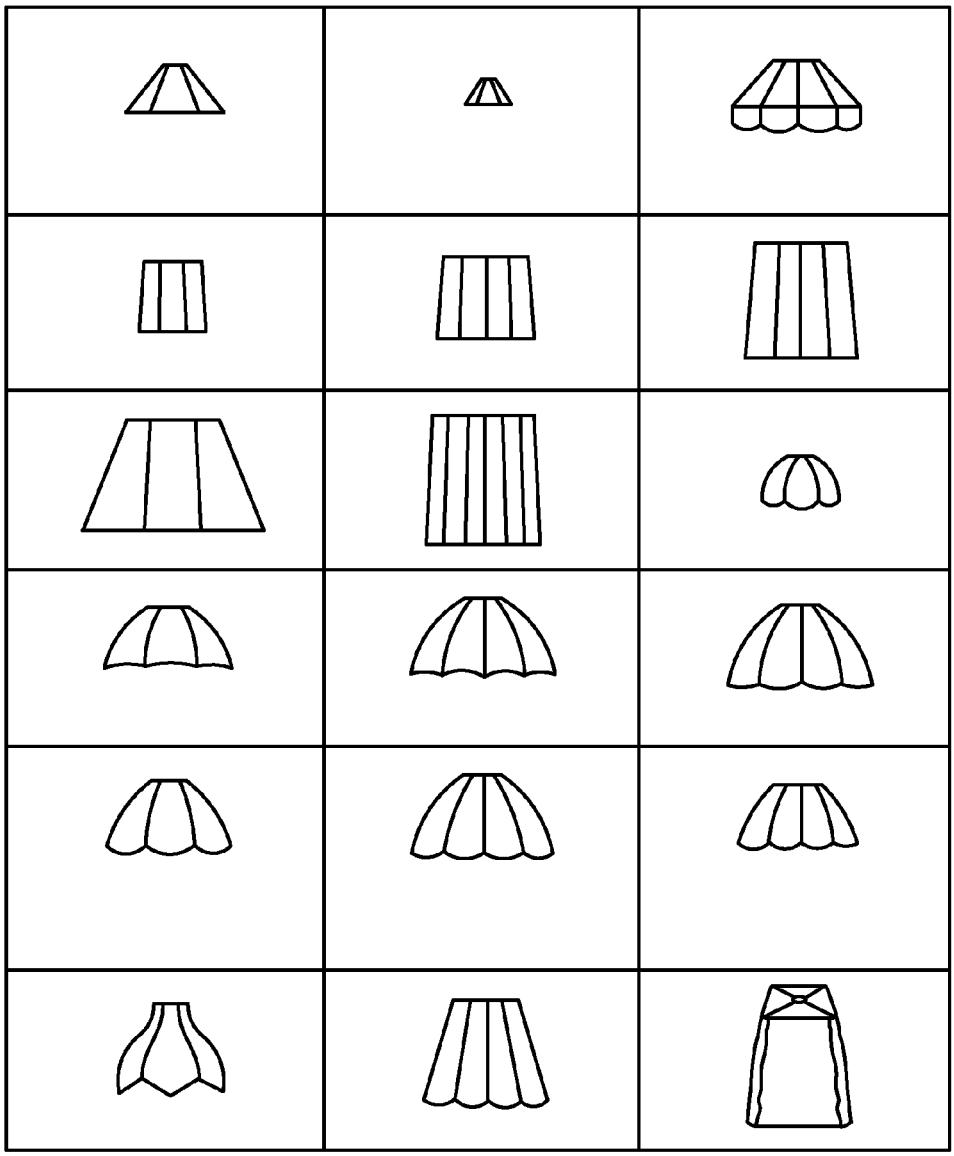
Figure 12C:
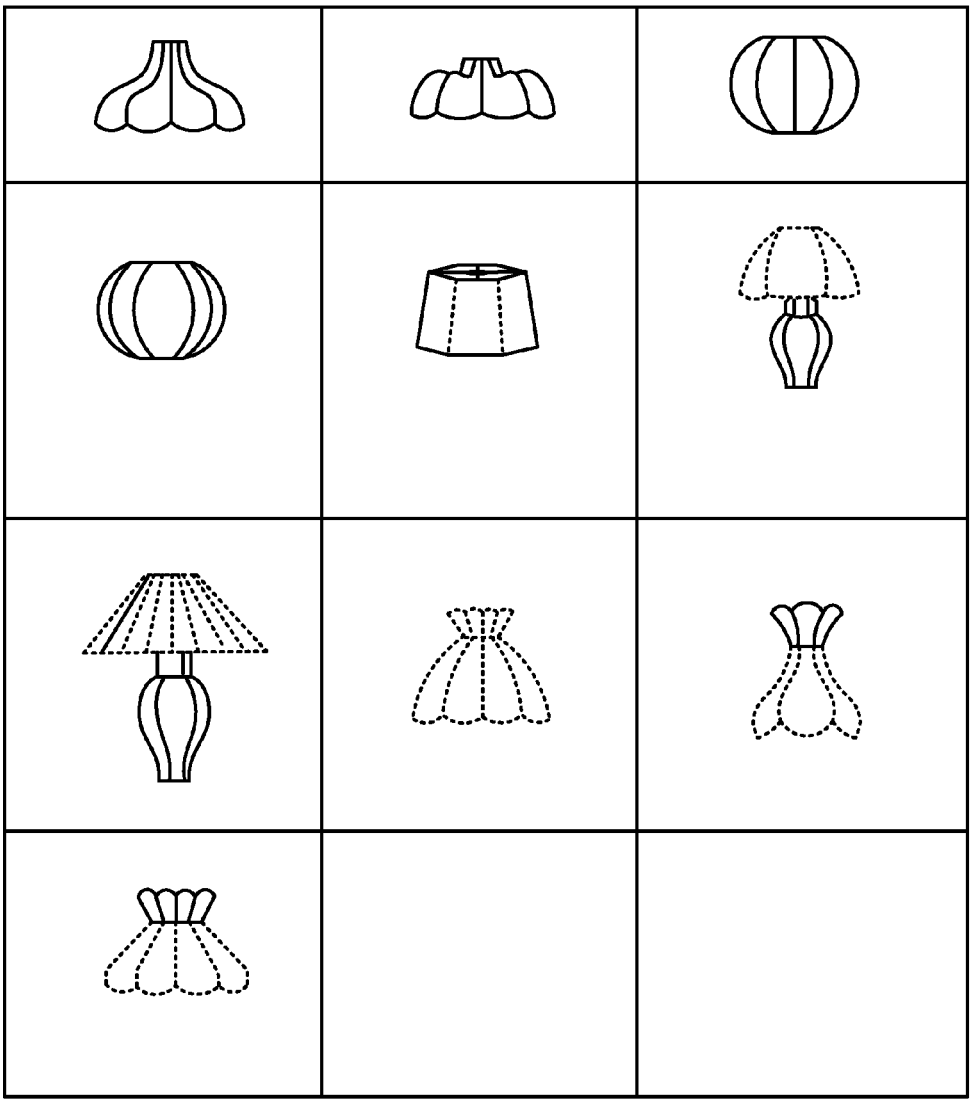

The panels 902 may be conformed or shaped to match contours or shapes of the lampshade 910. The panels 902 may be attached directly to the covering 904. In one example, the one or more panels 902 can match the unfolded shape of the lampshade 910 and fold with the forming of the lampshade 910 final shapes and positioning. The panels 902 may be offset from the covering 904 in order to control heat or control the amount of light passing through the covering. The panels 902 may be enveloped with the covering in an embodiment. The lampshades 910 may be in any variety of shapes, such as those shown in FIGS. 12A-C.

Circuitry is electrical circuitry that allows electricity to be delivered to the light emitters. Circuitry includes wires or conductors electrically connecting the emitters in the panels with an energy source. The energy source may be a traditional Edison Base. The circuitry may electrically contact the panels 102 in series or in parallel, for example. Electrical connection may be accomplished through the Edison Base and wires to the panels 102. Drivers and other electronic controls may be positioned near or in the base, which may be integrated with or adjacent to an Edison base. Although the amount of heat generated by LEDs is far less than that generated by a traditional Edison bulb, depending on the placement of LEDs relative to the covering, the amount of power supplied to the LEDs may be reduced in order to maintain a desired heat profile of panels 902. In embodiments in which the LEDs are deliberately underpowered, additional LEDs may be utilized in order to provide the desired overall luminosity.

The circuitry may be wiring that delivers household current (in US, 120V, 60 Hz, AC; in European Union, 230 V±6% at 50 Hz, AC.) or other source current. Circuitry can also provide control functions that convert the input current to a signal that can drive the light emitters. The drive signal can be more than about 5 V, about 3.5 V or less than 3.5 V. The drive signal is typically direct current. The drive signal for the light emitters can be semiconductors with light-emitting junctions designed to use low-voltage, constant current DC power to produce light. LEDs have polarity and, therefore, current only flows in one direction. Circuitry can also dim the light emitters by lowering the current or using Pulsed Width Modulation (PWM) to control the light output. LEDs have a very quick response time (~20 nanoseconds) and instantaneously reach full light output. Therefore, many of the undesirable effects resulting from varying current levels, such as wavelength shift or forward voltage changes, can be minimized by driving the light emitters at their rated current and rapidly switching that current on and off. This technique, known as PWM, is the best way to achieve stable results for applications that require dimming to less than 40% of rated current. By keeping the current at the rated level and varying the ratio of the pulse "on" time versus the time from pulse to pulse (commonly referred to as the duty cycle), the brightness can be lowered. The human eye cannot detect individual light pulses at a rate greater than 200 cycles per second and averages the light intensity thereby perceiving a lower level of light.

Figure 10:
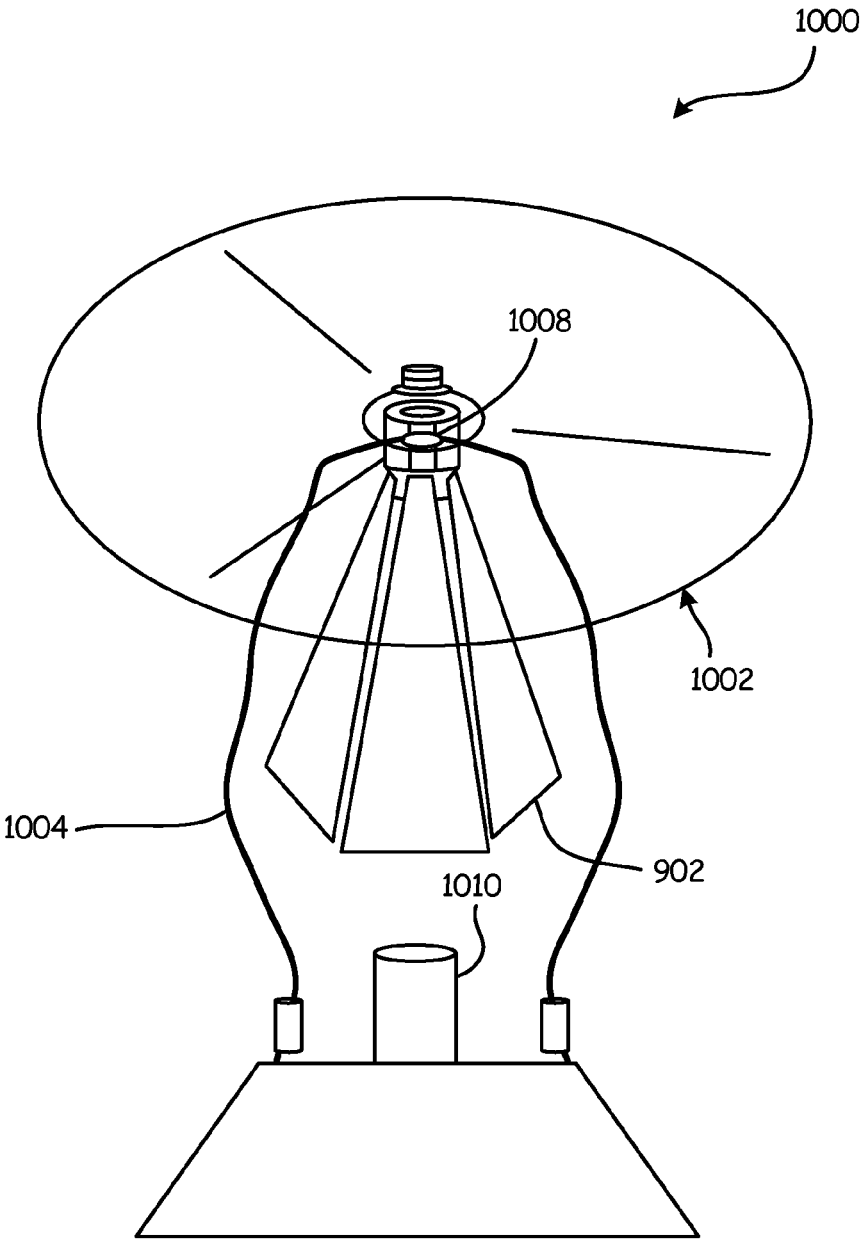
FIG. 10 is a perspective view of a lighting device according to an embodiment of the present invention.
Figure 11:
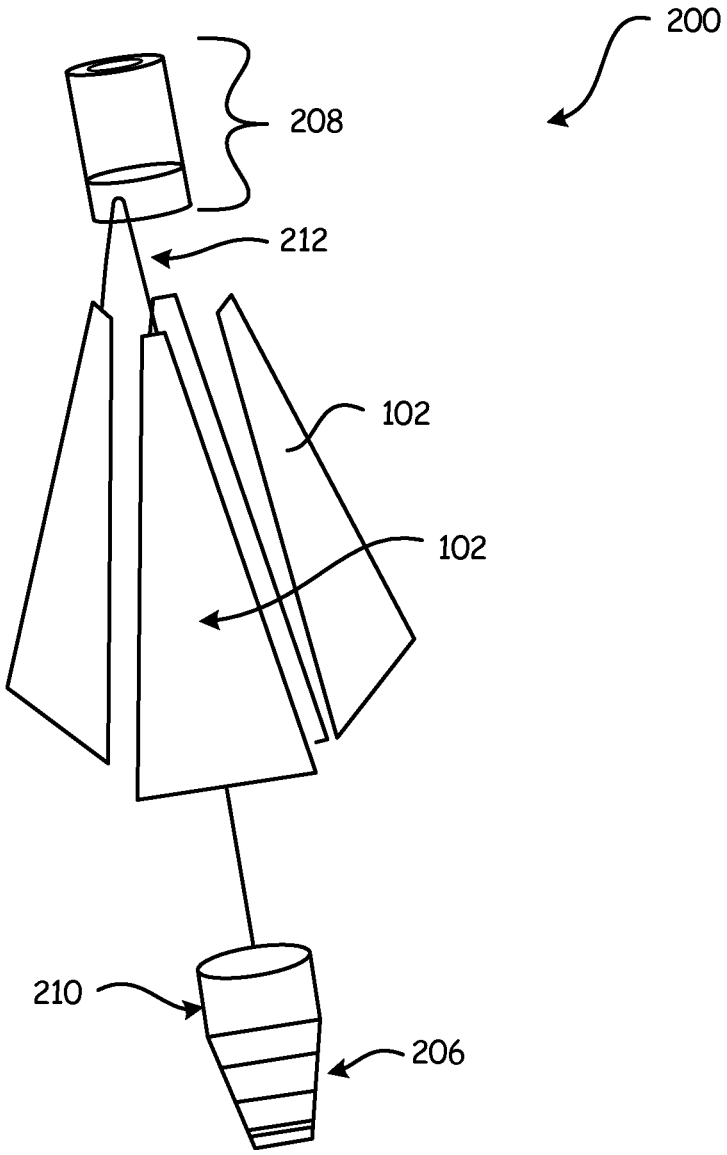
FIG. 11 is a perspective view of a lighting device according to an embodiment of the present invention.

Referring to FIG. 10A, a lighting device 1000 is shown, according to example embodiments. A lighting device 1000 may replace a lampshade or be optionally integrated with a lampshade. The device includes one or more illumination panels 902 suspended from an existing frame, such as a spider 1002 and harp frame 1004. The panels 002 can be configured to mimic the look of a lampshade or be integrated with an optional covering and wire frame to form an illuminated shade.

The lighting device may be positioned above the harp 1004 on a mounting component 1008 and below the spider 1002 holding a traditional lampshade. The lighting device then hangs in the space previously occupied by a traditional light bulb. Electrical connection may be accomplished through the Edison Base and wires to the panels 902. Drivers and other electronic controls may be positioned near or in the base 1010, which may be integrated with or adjacent to an Edison socket 1006. The mounting component 1008 may include one or more of a spider fitter, rings, finial, collector ring, etc. to support or secure the panels 902 and any connecting circuitry 1012.

Figure 13A:
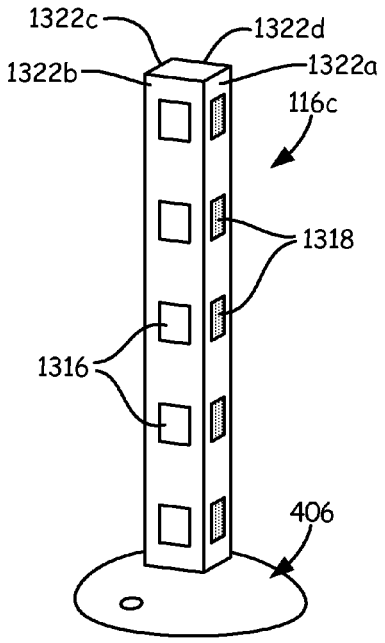
FIGS. 13A-B are perspective views of a lighting device according to an embodiment of the present invention.
Figure 13C:
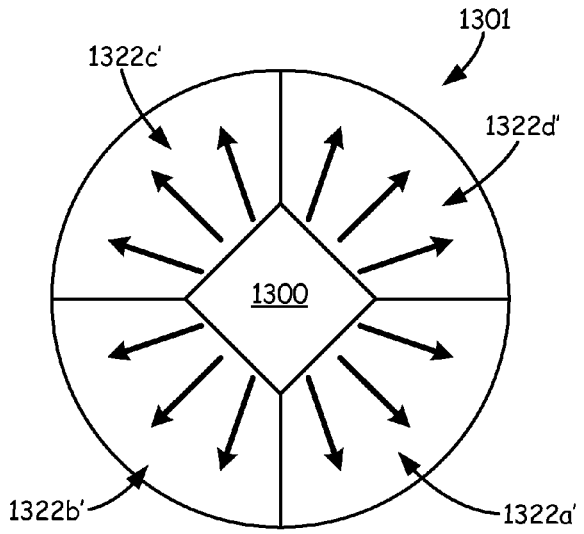
FIGS. 13C-D are lighting device illumination field schematics according to one embodiment of the present invention.
Figure 13B:
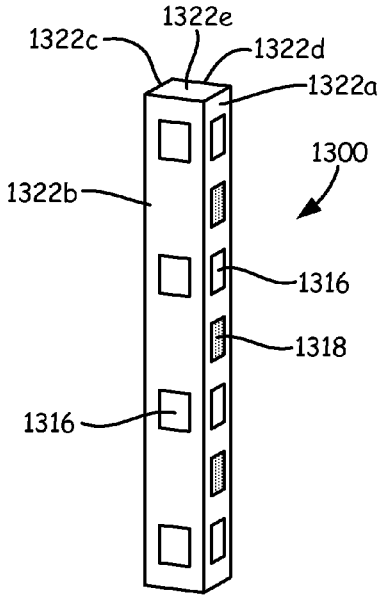

Referring to FIGS. 13A-B, perspective views of a lighting device are shown, according to an embodiment. An illuminating body 1300 can include one or more surfaces, such as surfaces 1322*a-d*, and optionally a base portion 406 for integration with other embodiments as described above. A surface can include a plurality of LEDs, such as a first plurality of LEDs 1316 on surface 1322*b* or a second plurality of LEDs on surface 1322*b* as shown in FIG. 13A. A plurality of LEDs can comprise one LED. In some embodiments, as shown in FIG. 13B, a first plurality of LEDs 1316 can occupy the same surface 1322*a* as a second plurality of LEDs 1318. Further, a plurality of LEDs can occupy a plurality of surfaces, such as first plurality of LEDs 1316 occupying surface 1322*a* and surface 1322*b*. In some embodiments, an illuminating body is configured such at the at least one LED of a plurality of LEDs emits light in a non-parallel direction in relation to the light emitted by at least one LED of a different plurality of LEDs. For example, a first LED can emit light in direction perpendicular to light emitted by a different LED.

The one or more LEDs comprising a given plurality of LEDs can be integrated with, connected to, or form a circuit. An illuminated body 1300 can include a plurality of LEDs 1316 connected to a first circuit. The same illuminated body can additionally include a second plurality of LEDs 1318 connected to the first circuit. In this example, the first plurality of LEDs 1316 can be differentiated from the second plurality of LEDs 1318 by LED intensity (e.g., voltage), LED color, or LED placement (e.g., surface). Alternatively, the second plurality of LEDs' 1318 can be connected to a second circuit. Embodiments including two circuits can further comprise an additional plurality of LEDs which are connected to both the first and second circuits. This example can be expanded to include additional pluralities of LEDs (e.g., a third plurality of LEDs, a fourth plurality of LEDs, etc.), each plurality of LEDs being connected to its own circuit or sharing a circuit with one or more other pluralities of LEDs.

A circuit providing power to a plurality of LEDs can be controlled by a switch. Where a configuration provides only one wiring path choice (i.e., the circuit) that the switch can adopt, other than open, the switch is known as a single-throw switch. In an "open" position, a switch is not in electric contact with a circuit or wiring path, and is not providing power thereto. Configurations providing two wiring path choices (i.e., the first circuit or the second circuit) that the switch can adopt, other than open, the switch is known as a double-throw, or multi-throw switch. A multi-throw switch, can refer to a switch that can adopt two or more wiring path choices. For example, a configuration can include a first circuit, a second circuit, and a third circuit connecting the first circuit and the second circuit. Such a configuration can be controlled by a triple-throw, or multi-throw, switch.

Figure 16:
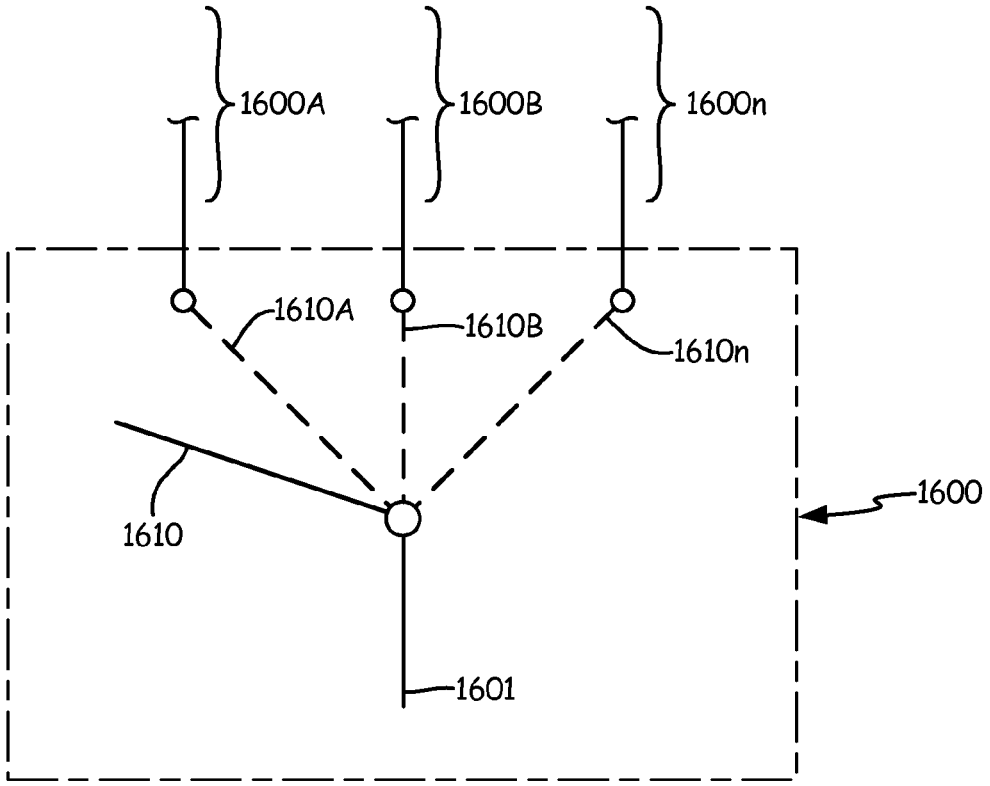
FIG. 16 is a schematic view of a multi-throw switch, according to an embodiment of the present invention.

A multi-throw switch 1600 is shown in FIG. 16, and includes a power input 1601, a first throw or circuit 1600A, a second throw or circuit 1600B and an nth throw or circuit 1600*n*. The nth throw or circuit can include 0-n circuits, wherein n is an integer. Multi-throw switch 1600 can select an open position 1610, a first position 1610A, a second position 1610B, or an nth position 1610*n*, wherein the nth position can include 0-n positions and n is determined by the number of throws included in the nth throw.

The embodiments disclosed herein can include multi-throw switches to harmoniously integrate the characteristics and advantages of LEDs with multi-purpose lighting aspects. In particular, embodiments including multi-throw switches can provide one or more of omni-directional lighting and task lighting. Omni-directional light includes light extending in all directions, or light which substantially illuminates a given area (e.g., a room). Task lighting includes light which extends in one direction or substantially one direction, or light which converges in and illuminates a common area or lighting field (e.g., a table top). Omni-directional lighting and task lighting can each be achieved individually in a given embodiment of an illuminated body, or an embodiment can be capable of achieving each individually or simultaneously. Similarly, an embodiment can achieve multiple task lighting and/or multiple omni-directional lighting individually or simultaneously.

Figure 13D:
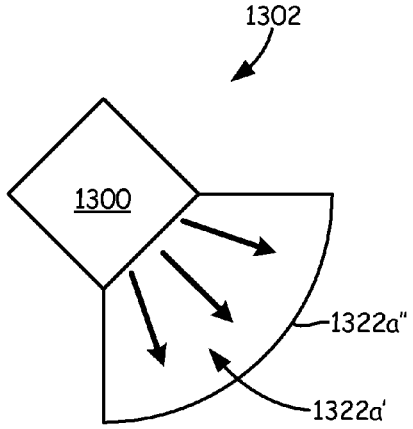

Referring to FIGS. 13C-D, illuminating body lighting field schematics are shown, according to one or more embodiments. FIGS. 13C-D can, in some embodiments, be top views of illuminating body 1300 shown in either FIG. 13A or FIG. 13B. FIG. 13C shows an example of omni-directional lighting 1301 as provided by illuminating body 1300, which includes lighting fields 1322*a'-d'*. Omni-directional lighting can be achieved through a number of design parameters of a given illuminated body, such as illuminated body 1300. Increasing a number of surfaces, a number of LEDs, the intensity of LEDs, or combinations thereof, can intensify an omni-directional lighting effect. For example, an illuminated body having four surfaces each including one or more LEDs may provide more robust omni-directional lighting than an illuminated body having three surfaces each including one or more LEDs. Illuminated body surfaces, such as surfaces 1322*a-d*, can be offset to enhance omni-directional lighting. Surfaces are considered offset when they are non-planar or non-contiguous.

In some embodiments, a plurality of omni-directional lighting aspects are achievable, including lighting intensity and lighting color. For example, an illuminating body can comprise one or a number of surfaces, each surface including at least one LED of a first color and at least one LED of a second color. Such an illuminating body could provide omni-directional lighting in two colors. Including a multi-throw switch would allow a user to choose between omni-directional lighting in one of each color, and further multi-aspect omni-directional lighting provided by both colors simultaneously.

Multiple omni-directional lighting aspects can occur discretely or simultaneously. Simultaneous multi-aspect omni-directional lighting can be achieved by including a first plurality of LEDs and a second plurality of LEDs on each surface of an illuminating body, wherein a switch can provide power to a circuit or path comprising both the first plurality of LEDs and the second plurality of LEDs. Discrete multi-aspect omni-directional lighting can be achieved by providing a multi-throw switch capable of selecting an open (e.g., off) position, a first position adopting a first wiring path comprising a first plurality of LEDs or a second position adopting a second wiring path comprising a second plurality of LEDs. Some embodiments provide for both discrete and simultaneous multi-aspect omni-directional lighting. For example, a multi-throw switch can be configured to adopt a wiring path choice which itself comprises two or more wiring paths (e.g., path 1 and path n, wherein n>=2) wherein each path comprises a plurality of LEDs. In this example, the multi-throw switch can adopt an open position, a first position adopting path 1, n positions each adopting paths 2 to n, and an n+1 position adopting a path comprising 2 or more of paths 1–n. The n+1 position can comprise several positions, each position adopting any combination of 2 or more paths from paths 1–n. Specifically, this example can include a triple-throw switch capable of selecting one of a first path comprising one or more LEDs of a given intensity, a second path comprising one or more LEDs of an intensity different from the intensity of the one or more LEDs of the first path, and a third path comprising the first path and the second path.

Another embodiment providing discrete and simultaneous multi-aspect omni-directional lighting includes a multi-throw switch capable of selecting an open position, a first position adopting a first wiring path comprising a first plurality of LEDs or a second position adopting a second wiring path comprising a second plurality of LEDs. This embodiment further includes a third plurality of LEDs which are connected to both the first wiring path and the second wiring path, and are energized when the multi-throw switch selects either the first position or the second position.

Multi-aspect omni-directional lighting can further include various configurations which can adapt to a given lighting environment and provide enhanced operating efficiency. For example, FIG. 13C shows an omni-directional lighting 1301 scheme which may be suitable for an illuminated body 1300 placed in the center of a lighting environment (e.g., a room). If surface 1322*a* is placed continuous with or near an obstruction (e.g., a wall), lighting fields 1322*b*'-*d*' can be selectively energized to provide omni-directional lighting without illuminating lighting field 1322*a*' in order to avoid an energy expenditure on illumination which would otherwise be absorbed by the obstruction.

FIG. 13D shows an example of task lighting 1302 as provided by illuminating body 1300, which includes a single lighting field as can be defined by one or more of plane 1322*a*' and plane 1322*a*". For example, plane 1322*a*' can represent a table top and plane 1322*a*" can represent a treasured tapestry hanging on a wall. FIG. 13D depicts a task lighting field as defined by perpendicular planes; however, a task lighting field can be defined by all manner of configurations, chiefly as defined by an illuminated target or targets (e.g., a table top and/or treasured tapestry). In other embodiments, task lighting is not defined by a lighting field or target object, but rather the characteristic(s) of the illumination itself. For example, task lighting can comprise a particular color or intensity of illumination, the direction of illumination relative to the originating illuminated body or one or more task lighting instances, or a pattern of illumination created by a particular configuration of a plurality of LEDs.

Figure 14A:
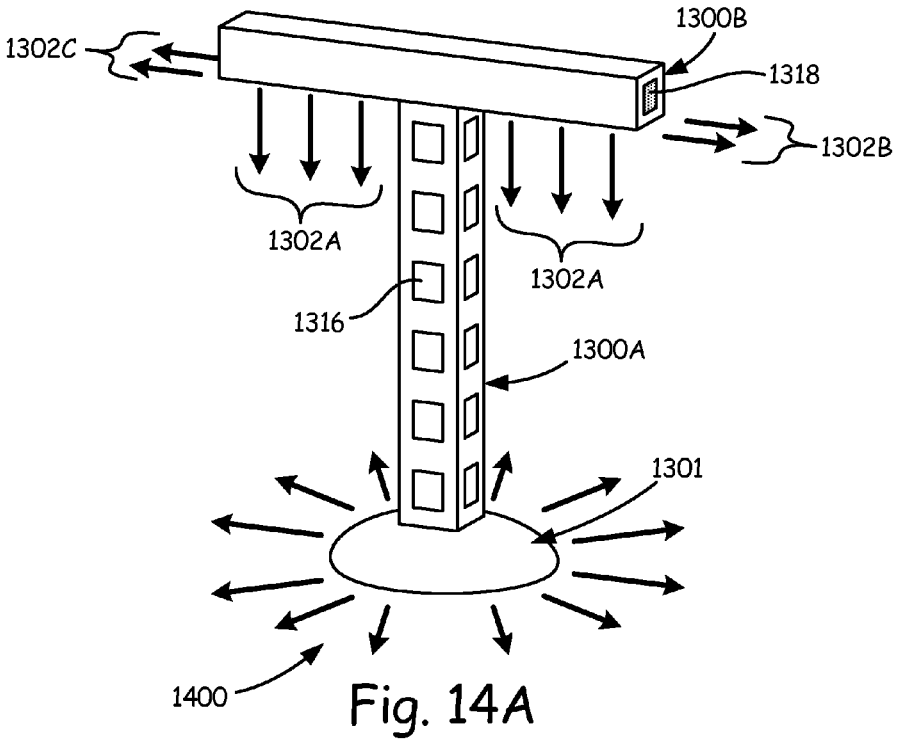
FIG. 14A is a perspective view of a lighting device according to an embodiment of the present invention.

Some embodiments of illuminated bodies comprise multi-throw switches in order to provide one or more aspects of task lighting, one or more aspects of omni-directional lighting, or combinations thereof. Referring to FIG. 14A, a perspective view of an illuminated body 1400 is shown. Illuminated body 1400 comprises a first plurality of LEDs 1316 included or retained by illuminating body member 1300A and shown providing omni-directional lighting 1301, and a second plurality of LEDs 1318 included or retained by illuminating body member 1300B and providing multi-aspect task lighting 1302A-C. Second plurality of LEDs 1318 can comprise a first task LED plurality (not shown) for providing task lighting 1302A, a second task LED plurality for providing task lighting 1302B, and a third task LED plurality for providing task lighting 1302C (not shown). In some embodiments, an illuminating body is configured such at the at least one LED of a plurality of LEDs emits light in a non-parallel and non-planar direction in relation to the light emitted by at least one LED of a different plurality of LEDs. For example, a first plurality of LEDs 1316 can emit light in non-parallel yet planar directions, and a second plurality of LEDs 1318 can emit light in a direction which is not planar to any light emitted by the first plurality of LEDs 1316. For Example, an illuminated body 1400 can emit planar light 1301 via a first plurality of LEDs 1316 and light 1302A, which is perpendicular to light 1301, by a second plurality of LEDs 1318.

Many embodiments include a multi-throw switch, enabling an illuminated body, such as illuminated body 1400, to provide multi-aspect task lighting. Multiple task lighting aspects can occur discretely or simultaneously. Simultaneous multi-aspect task lighting can be achieved, for example, by including a first plurality of LEDs and a second plurality of LEDs on separate surfaces of an illuminating body, wherein a switch can provide power to a circuit or path comprising both the first plurality of LEDs and the second plurality of LEDs. For example, lighting field 1322*a*' and lighting field 1322*c*' can be simultaneously illuminated to achieve simultaneous multi-aspect task lighting.

Discrete multi-aspect task lighting can be achieved by a single illuminating body, such as illuminating body 1400, by providing a multi-throw switch capable of selecting an open (e.g., off) position, a first position adopting a first wiring path comprising a first plurality of LEDs or a second position adopting a second wiring path comprising a second plurality of LEDs. Some embodiments provide for both discrete and simultaneous multi-aspect task lighting. For example, a multi-throw switch can be configured to adopt a wiring path choice which itself comprises two or more wiring paths (e.g., path 1 to path n, wherein n>=2), wherein each path comprises a plurality of LEDs. In this example, the multi-throw switch can adopt an open position, a first position adopting path 1, n positions each adopting paths 2 to n, and an n+1 position adopting a path comprising 2 or more of paths 1-n. The n+1 position can comprise several positions, each position adopting any combination of 2 or more paths from paths 1-n. Specifically, this example can include a triple-throw switch capable of selecting one of a first path comprising one or more LEDs capable of illuminating a particular task light field, such as lighting field 1302B, a second path comprising one or more LEDs capable of illuminating a particular task light field different from the task lighting field illuminated by the first path, such as lighting field 1302C, and a third path comprising the first path and the second path.

Embodiments also include illuminated bodies capable of providing one or more of single aspect omni-directional lighting, discrete and simultaneous multi-aspect omni-directional lighting, single aspect task lighting, and discrete and simultaneous task lighting. In an example, Illuminated body 1400 shown in FIG. 14A can be configured such that a first plurality of LEDs 1316 belong to a first circuit, a second plurality of LEDs for providing task lighting 1302A belong to a second circuit, and a third circuit connects the first circuit and the second circuit. A triple-throw switch can select between an open position, a first position powering the first circuit to provide omni-directional lighting 1301, a second position powering the second circuit to provide task lighting 1302A, or a third position to provide omni-directional lighting 1301 and task lighting 1302A.

In some other embodiments, a plurality of LEDs can comprise a portion of the LEDs which provide omni-directional lighting, and further provide task lighting. In an example, illuminated body 1300 shown in FIG. 13B can be configured such that a first plurality of LEDs 1316 are distributed between surfaces 1322*b-d* and belong to a first circuit, and a second plurality of LEDs 1318 are distributed throughout surface 1322*a* and belong to both the first circuit and a second circuit. A double-throw switch can select between an open position, a first position powering the first circuit to provide omni-direction light cooperatively from the first plurality of LEDs 1316 and the second plurality of LEDs, and a second position to provide task lighting from the second plurality of LEDs 1318.

Figure 14B:
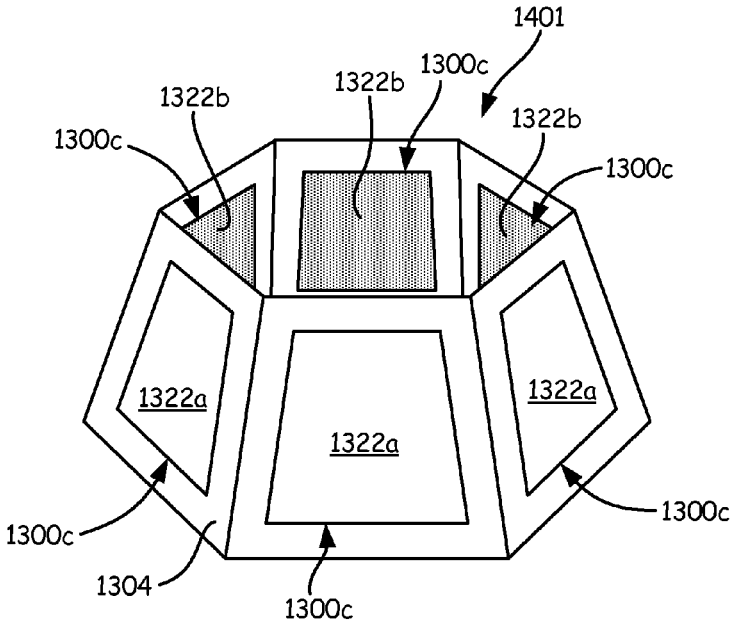
FIG. 14B is a perspective view of an illuminating lamp shade according to an embodiment of the present invention.

In some embodiments, omni-directional lighting, task lighting, and combinations thereof can originate from a plurality of light-emitting sources. Referring to FIG. 14B, a perspective view of an illuminating lampshade 1401 is shown, according to an embodiment. Illuminating lampshade 1401 comprises a covering material 1304 which includes or retains a number of illuminating panels 1300*c* all angled inward. Each illuminating panel comprising an inner illuminating side 1322*b* and an outer illuminating side 1322*a*. One or more of the inner illuminating sides 1322*b* can be included in a first circuit and one or more of the outer illuminating sides 1322*a* can be included in a second circuit. When a multi-throw switch selects the first circuit, the inner illuminating sides 1322*b* provide illumination which converges downward to provide task lighting beneath the lampshade. When the multi-throw switch selects the second circuit, the outer illuminating sides 1322*a* provide illumination which projects outward from the illuminating lampshade to provide omni-directional lighting.

Referring to FIGS. 15A-E, a modular lighting system 1500 is shown, according to some embodiments. Modular lighting system 1500 includes a cross-shaped hub module 1511, and a plurality of tubular illuminating modules 1510. Modular lighting system 1500 is shown in combination with lampshade 120, structuring rod 1520, and power converter base 114. Power converter base 114, such as described above, provides power to the modular lighting system 1500 from a power source. Modular lighting system 1500 can comprise one or more structuring rods 1520 as needed to position hub modules 1511, illuminating modules 1510, lampshade 120, power converter base 114, and the like. Structuring rods 1520 can include a hollow center or portion capable of housing electrical wires.

Illuminating modules 1510 comprise a body defining at least one surface which includes or retains one or more LEDs, such as first plurality of LEDs 1516 and second plurality of LEDs 1518. A plurality of LEDs can be positioned on one or more surfaces of an illuminating module 1510. Illuminating modules 1510 can be constructed from materials such as high density polymers, plastics, and the like. In some embodiments at least a portion of an illuminating module 1510 comprises a metal, such as aluminum, which serves as one or more of a structural support or an LED heat sink. In some embodiments, an illuminating module 1510 includes or retains one or more LEDs from two or more separate pluralities of LEDs. An LED included or retained by an illuminating module 1510 can be connected to one or more circuits. A hub module 1511 can similarly comprise a plurality of LEDs.

An illuminating module 1510 further comprises a power-receiving port 1530, and can additionally comprise a power-providing port 1531. An illuminating module which comprises a power-providing port 1531 can be considered a hub module 1511. A hub module can further comprise two or more power providing ports 1531 and/or two or more power receiving ports 1530. Port 1530 and port 1531 each comprise an electrical connection means 1536. A power-providing port 1530 of an illuminating module 1510 can be configured to provide power to a power-receiving port 1531 of a different illuminating module 1510.

A power-receiving port 1531 of an illuminating module 1510 can be configured to receive power from one or more of a power providing port 1530 of a different illuminating module, a hub module, a power converter base 114, or a power source. Port 1530 and port 1531 can include several electrical contacts such that one or more electric circuits can be achieved between illuminating modules, hub modules, and combinations thereof.

Figure 15A:
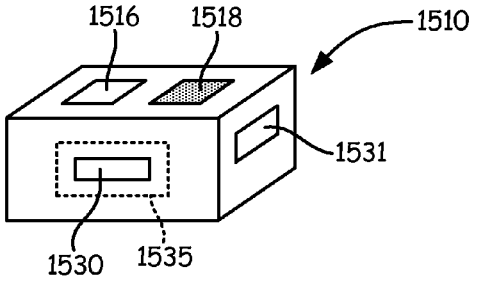
FIGS. 15A-D are perspective views of lighting system modules according to one or more embodiments of the present invention.
Figure 15B:
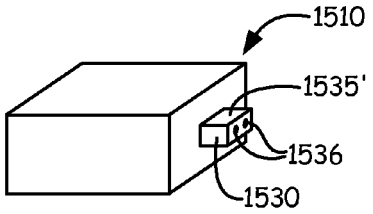
Figure 15C:
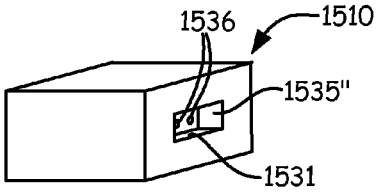

Port 1530 and port 1531 cam additionally comprise a physical connection means 1535. As shown in FIGS. 15B-C, a physical connection means can comprise a male connection means 1531' and a female connection means 1531", wherein female adaptor is configured to mate within a male connection means. Male/female physical connection means are interchangeable between port 1530 and port 1531, and other connection means are suitable as would be known by one of skill in the art after review of this disclosure. A USB is an electrical and physical connection means known in the art and suitable for use with the embodiments described herein.

In its most basic form, modular lighting system 1500 comprises a two illuminating modules 1510, each module comprising at least one LED and a power-receiving port 1530. The at least one LED is connected to a circuit. One of the two illuminating modules 1510 further comprises a power-providing port 1531. In other embodiments, a modular lighting system 1500 can further comprise one or more illuminating modules 1510 and/or one or more hub modules, which connect to one another via power receiving ports 1531 and power providing ports 1531. In some embodiments a hub module can include a plurality of LEDs.

Figure 15D:
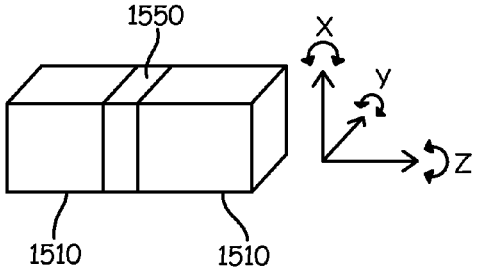
Figure 15E:
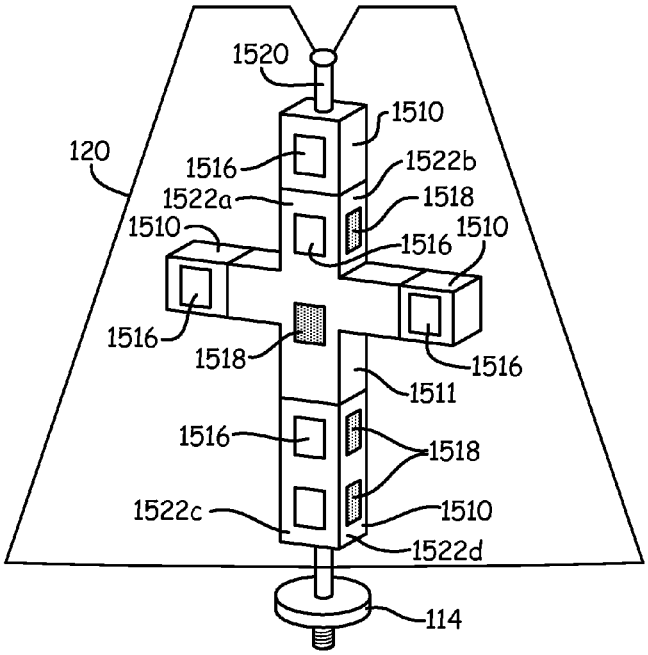
FIG. 15E is a perspective view of a modular lighting system according to an embodiment of the present invention.

As shown in FIG. 15E, a modular lighting system 1500 can be customized to include a number of modules, and customization can cater to a given spatial constraint such as that of a lampshade 120. Modules can be connected and disconnected for multiple uses or as purposes or preferences change. For example, a newly purchased lamp shade can necessitate a rearrangement of modules. Similarly, a desire for a different lighting scheme can prompt the same. As shown in FIG. 15D, an illuminating module 1510 can comprise a connector 1550, which enables the illuminating module 1510 to rotate in relation to a hub module 1511 or an illuminating module 1510 to which it is connected. Connector 1550 can allow rotation in an x-axis, a y-axis, a z-axis, or combinations thereof. Rotation about an axis can be restricted (e.g., 90 degrees of allowable rotation), or allow for full rotation.

In some embodiments, a hub module 1511 comprises one or more circuits, and optionally a plurality of LEDs connected to the one or more circuits. Such embodiments can further include a multi-throw switch for providing power to the one or more circuits. Illuminating modules 1510 can electrically connect to the hub module 1511, other illuminating modules 1510, or additional hub modules 1511, if present. The one or more circuits of the one or more hub modules 1511 can be capable of connecting to each circuit of the illuminating modules 1510. In some embodiments, illuminating modules comprise two or more circuits.

A modular lighting system 1500 can be configured to provide one or more of omni-directional lighting and task lighting, as described above. Further, the modular aspects described herein allow for aesthetics and functionality to be readily combined. In some embodiments, a modular lighting system 1500 can comprise a number of illuminating modules 1510 including a first plurality of LEDs 1516, which, when connected to a first circuit, can provide omni-directional light. One or more illuminating modules 1510 of the modular lighting system 1500 can additionally or alternatively comprise an additional plurality of LEDs 1518 capable of connecting to the first circuit, a second circuit, or both, for example, and providing task lighting. A The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separate embodiment.

The invention claimed is:

1. A lighting device, comprising:

an illuminated body that includes or retains a first plurality of solid-state light emitters oriented to provide omni-directional lighting and a second plurality of solid-state light emitters oriented to only provide light extending in substantially one direction;

a first electric circuit connected to provide power to the first plurality of solid-state light emitters;

a second electric circuit connected to provide power to the second plurality of solid-state light emitters; and a multi-throw switch coupled to selectively provide power to the first plurality of solid-state light emitters, the second plurality of solid-state light emitters, or both the first plurality of solid-state light emitters and the second plurality of solid-state light emitters.

2. The lighting device of claim 1, further comprising a third plurality of solid-state light emitters connected to both the first circuit and the second circuit.

3. The illuminated body of claim 1, further comprising two or more surfaces wherein one or more of the two or more surfaces includes or retains at least a portion of solid-state light emitters from the first plurality of solid-state light emitters, wherein the first surface is offset from the second surface.

4. The lighting device of claim 1, further comprising a second illuminated body that includes or retains at least one solid-state light emitter, wherein the at least one solid-state light emitter is connected with at least one of the first circuit and the second circuit.

5. The lighting device of claim 4, wherein the second illuminated body is positioned offset from the illuminated body.

6. The lighting device of claim 1, wherein at least one of the first plurality of solid-state light emitters emits light in a non-planar and non-parallel direction to at least one of the second plurality of solid-state light emitters.

7. The lighting device of claim 1, further comprising a third circuit connecting the first circuit to the second circuit.

8. The lighting device of claim 1, wherein actuating the multi-throw switch between a plurality of settings energizes no electric circuits, the first electric circuit, the second electric circuit, or both the first electric circuit and the second electric circuit.

* * * * *